US012577070B2

(12) United States Patent
Ichikawa et al.

(10) Patent No.: US 12,577,070 B2
(45) Date of Patent: Mar. 17, 2026

(54) FOIL TRANSFER FILM CARTRIDGE AND FOIL TRANSFER DEVICE

(71) Applicant: BROTHER KOGYO KABUSHIKI KAISHA, Nagoya (JP)

(72) Inventors: Tomoya Ichikawa, Nagoya (JP); Tomoya Yamamoto, Kasugai (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 425 days.

(21) Appl. No.: 17/807,201

(22) Filed: Jun. 16, 2022

(65) Prior Publication Data

US 2022/0306416 A1 Sep. 29, 2022

Related U.S. Application Data

(63) Continuation of application No. PCT/JP2020/035703, filed on Sep. 23, 2020.

(30) Foreign Application Priority Data

Dec. 27, 2019 (JP) ..... 2019-239256
Apr. 1, 2020 (JP) ..... 2020-065620

(51) Int. Cl.
*B65H 7/06* (2006.01)
*B65H 5/06* (2006.01)
*B65H 7/20* (2006.01)

(52) U.S. Cl.
CPC ..... *B65H 7/06* (2013.01); *B65H 5/068* (2013.01); *B65H 7/20* (2013.01); *B65H 2511/12* (2013.01);
(Continued)

(58) Field of Classification Search
CPC ..... B41F 16/0013; B41F 16/0046; B41F 16/006; B41F 19/005; B41F 33/02;
(Continued)

(56) References Cited

U.S. PATENT DOCUMENTS 1,908,121 A * 5/1933 Crafts ..... B65H 23/02 242/596.5
3,816,207 A 6/1974 Kinslow
(Continued)

FOREIGN PATENT DOCUMENTS

CN 1749016 A 3/2006
CN 102145589 A 8/2011
(Continued)

OTHER PUBLICATIONS

Translation of DE102006062012.*
(Continued)

*Primary Examiner* — Sonya M Sengupta
(74) *Attorney, Agent, or Firm* — Merchant & Gould P.C.

(57) ABSTRACT

A foil transfer film cartridge includes a supply reel on which a foil film having a widthwise dimension of a first width is wound, and a supply shaft longer in a widthwise direction of the foil film than the first width. The supply shaft is configured to support the supply reel in a manner that allows the supply reel to move in the widthwise direction between a first position and a second position different from the first position.

31 Claims, 20 Drawing Sheets

(52) U.S. Cl.
CPC .... *B65H 2511/16* (2013.01); *B65H 2701/528* (2013.01); *B65H 2801/15* (2013.01)

(58) Field of Classification Search
CPC ..... B41F 33/14; B41F 33/16; G03G 15/6582; B65H 19/305; B65H 23/02; B65H 2405/42; B65H 2511/12; B65H 2511/16; B65H 2701/528; B65H 2801/15; B65H 5/068; B65H 7/06; B65H 7/20; B65C 9/18; B41P 2219/21; B41P 2219/22; B41P 2219/23; B41P 2219/31; B41P 2219/42; B41P 2233/10; B41P 2233/13; B41J 17/02; B41J 17/22; B41J 17/32; B41J 2/325
See application file for complete search history.

(56) References Cited

U.S. PATENT DOCUMENTS

| | | | | |
|---|---|---|---|---|
| 4,729,519 | A * | 3/1988 | Tafel | B65H 19/1863 242/560.3 |
| 4,892,425 | A | 1/1990 | Shimizu et al. | |
| 5,915,860 | A | 6/1999 | Laurent | |
| 6,206,990 | B1 | 3/2001 | Glenn | |
| 6,688,549 | B1 | 2/2004 | Shen | |
| 7,128,291 | B1 | 10/2006 | Schanke et al. | |
| 7,867,593 | B2 | 1/2011 | Hoshino et al. | |
| 8,368,732 | B2 | 2/2013 | Matsushima et al. | |
| 8,649,721 | B2 | 2/2014 | Kosasa | |
| 9,656,455 | B2 | 5/2017 | Sun | |
| 11,772,412 | B2 | 10/2023 | Yamamoto | |
| 2002/0060259 | A1 | 5/2002 | Kitayama | |
| 2005/0214054 | A1 | 9/2005 | Hoshino et al. | |
| 2011/0193925 | A1 | 8/2011 | Matsushima et al. | |
| 2021/0347198 | A1 | 11/2021 | Yamamoto | |
| 2022/0016878 | A1 | 1/2022 | Yamamoto | |
| 2022/0289520 | A1* | 9/2022 | Itabashi | B41J 17/32 |
| 2022/0306416 | A1* | 9/2022 | Ichikawa | B65H 7/20 |
| 2023/0415507 | A1 | 12/2023 | Yamamoto | |

FOREIGN PATENT DOCUMENTS

| | | | | |
|---|---|---|---|---|
| CN | 204820665 | U | 12/2015 | |
| CN | 206561677 | U | 10/2017 | |
| CN | 109016815 | A | 12/2018 | |
| CN | 110040317 | A | 7/2019 | |
| DE | 101 48 975 | A1 | 4/2003 | |
| EP | 0272951 | A2 * | 6/1988 | B41F 19/062 |
| GB | 1 324 183 | A | 7/1973 | |
| JP | 59-186857 | A | 10/1984 | |
| JP | 6-99632 | A | 4/1994 | |
| JP | 7-290685 | A | 11/1995 | |
| JP | 2005-266180 | A | 9/2005 | |
| JP | 2007-55168 | A | 3/2007 | |
| JP | 2011-20690 | A | 2/2011 | |
| JP | 2012-45718 | A | 3/2012 | |
| JP | 2012-153438 | A | 8/2012 | |
| JP | 2019-45653 | A | 3/2019 | |
| JP | 2019-171611 | A | 10/2019 | |
| WO | WO-03035403 | A1 * | 5/2003 | B41J 2/325 |
| WO | 2020/158004 | A1 | 8/2020 | |
| WO | 2021/060129 | A1 | 4/2021 | |

OTHER PUBLICATIONS

The First Office Action issued in corresponding Chinese Patent Application No. 202080090026.3, Apr. 12, 2023.
English translation of The First Office Action issued in corresponding Chinese Patent Application No. 202080090026.3, Apr. 12, 2023.
International Search Report issued in corresponding International Patent Application No. PCT/JP2020/035703, dated Oct. 27, 2020.
International Preliminary Report on Patentability and Written Opinion of the International Searching Authority issued in corresponding International Patent Application No. PCT/JP2020/035703, dated Jun. 28, 2022.
Office Action issued in corresponding Japanese Patent Application No. 2020-065620, Oct. 17, 2023.
Office Action issued in corresponding Chinese Patent Application No. 202080090026.3, Nov. 1, 2023.
Extended European Search Report in corresponding European Patent Application No. 20907079.6, Jan. 4, 2024.

* cited by examiner

| | CENTER SHEET SENSOR | SIDE SHEET SENSOR |
|---|---|---|
| SH1 | ON | ON |
| SH2 | ON | — |
| SH3 | ON | ON |

| | FIRST SENSOR | SECOND SENSOR |
|---|---|---|
| NOT INSTALLED | OFF | OFF |
| FC1 | ON | OFF |
| FC2 | OFF | ON |
| FC3 | ON | ON |

FIG.17A
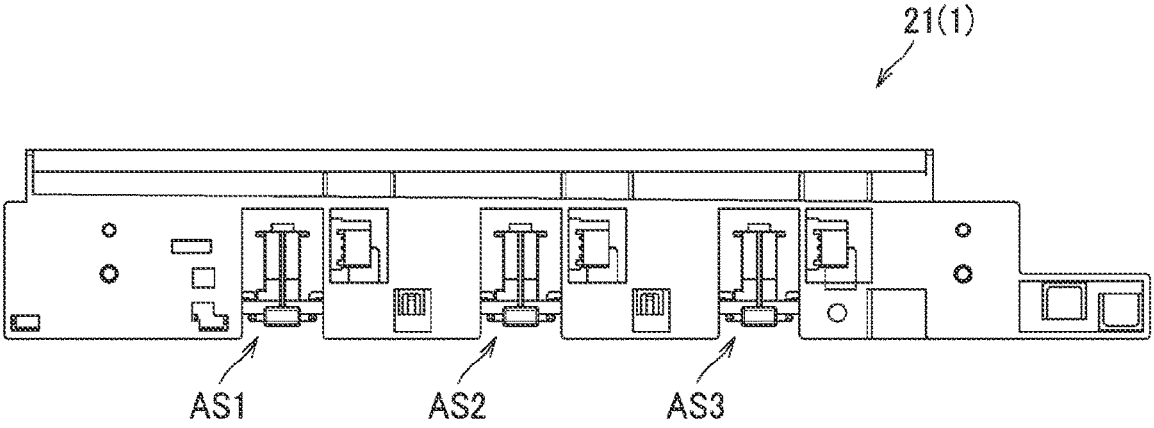
FIG.17B
| FIRST SENSOR | SECOND SENSOR | THIRD SENSOR | DETECTION RESULT |
|---|---|---|---|
| LOW | LOW | LOW | FU1 |
| LOW | HIGH | LOW | FU2 |
| HIGH | LOW | LOW | FU3 |
| HIGH | HIGH | HIGH | NOT INSTALLED |
FIG.18
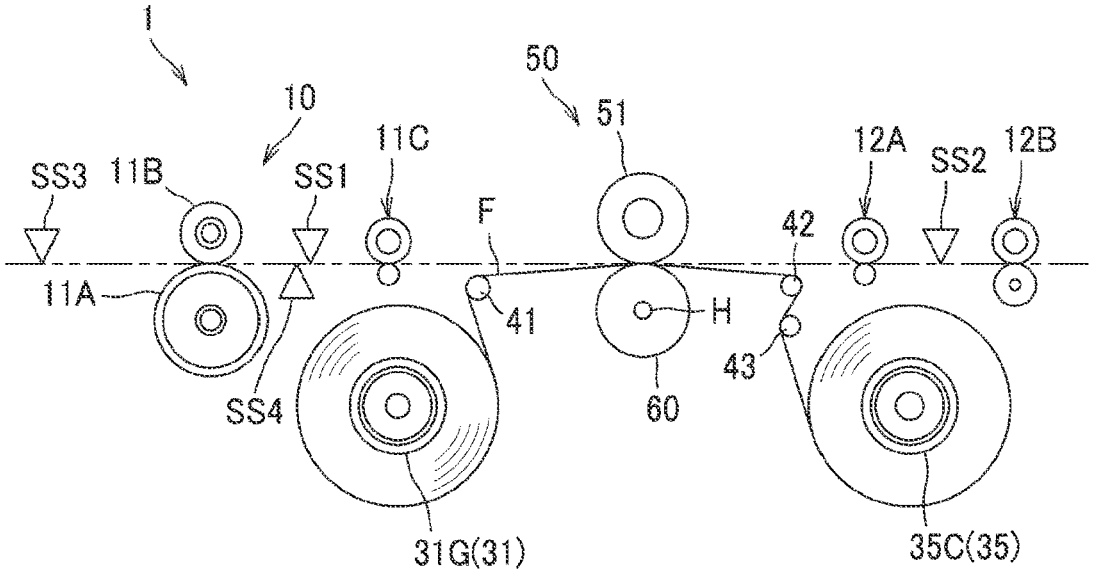

FOIL TRANSFER FILM CARTRIDGE AND FOIL TRANSFER DEVICE

CROSS REFERENCE TO RELATED APPLICATIONS

This application is a continuation application of International Application No. PCT/JP2020/035703 filed on Sep. 23, 2020 which claims priority from Japanese Patent Application Nos. 2019-239256 and 2020-065620 respectively filed on Dec. 27, 2019 and Apr. 1, 2020. The entire contents of the priority applications are incorporated herein by reference.

BACKGROUND ART

A foil transfer device comprising a cartridge including a supply reel on which a foil film is wound and a take-up reel to take up the foil film, and a housing main body in which the cartridge is installable into and removable from is conventionally known in the art.

DESCRIPTION

In such a foil transfer device, it is desired to change a widthwise position of the foil film in order to achieve various types of foil transfer. However, manufacturing a plurality of types of cartridges according to desired widthwise positions of the foil film will increase the number of cartridges a user possesses, and reduce the convenience of the user.

It would be desirable to provide a foil transfer film cartridge and a foil transfer device that can increase the convenience of the user.

In one aspect, a foil transfer film cartridge disclosed herein comprises a supply reel on which a foil film having a widthwise dimension of a first width is wound, and a supply shaft longer in a widthwise direction of the foil film than the first width. The supply shaft is configured to support the supply reel in a manner that allows the supply reel to move in the widthwise direction between a first position and a second position different from the first position.

According to this configuration, the widthwise position of the foil film can be changed in one foil transfer film cartridge. Thus, the user does not have to possess many cartridges and the convenience of the user can thereby be improved.

The above and other aspects, their advantages and further features will become more apparent by describing in detail illustrative, non-limiting embodiments thereof with reference to the accompanying drawings briefly described below.

Figure 10A:
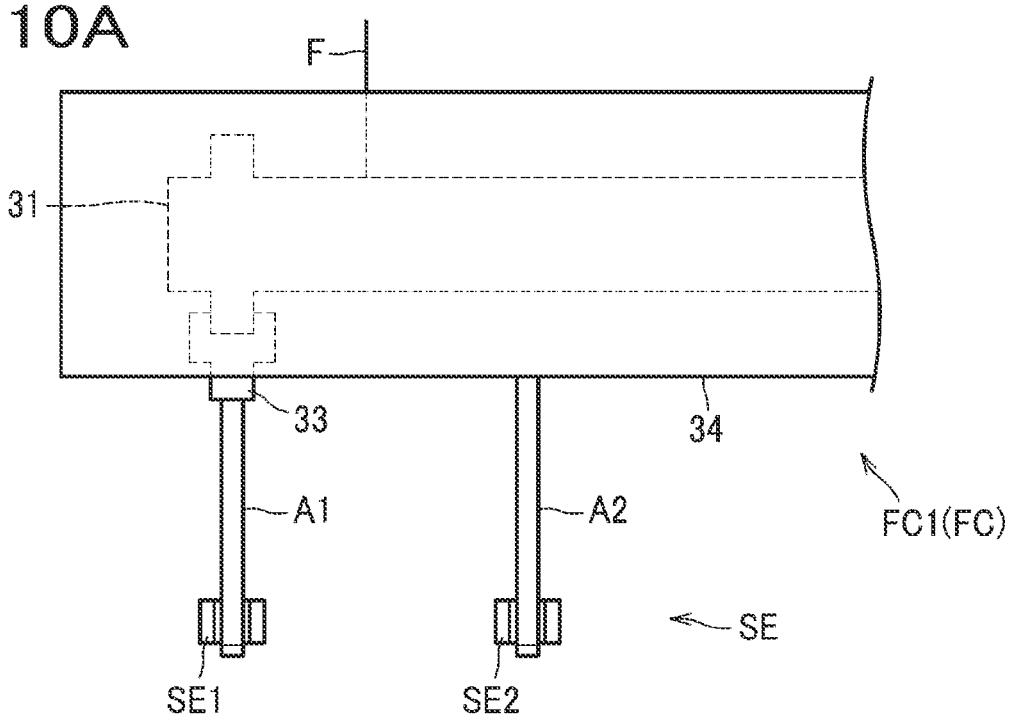
FIG. 10A is an illustration showing sensors for detecting a lever and other components.
Figure 10B:
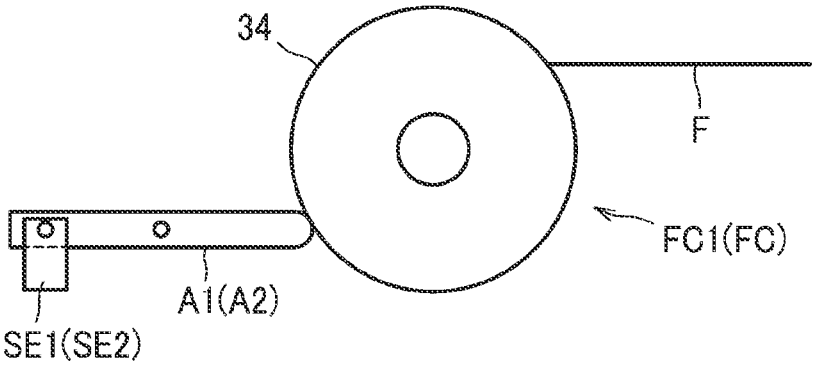
FIG. 10B is an illustration showing the sensor and the lever in a non-detection position.
Figure 10C:
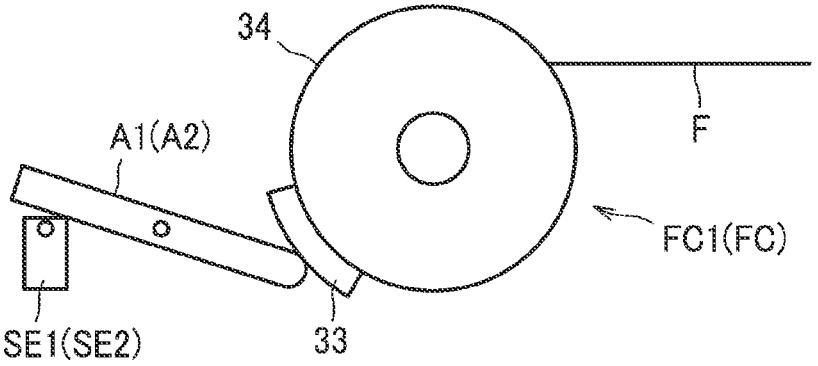

FIG. 10C an illustration showing the sensor and the lever in a detection position.

Figures 11, 12:
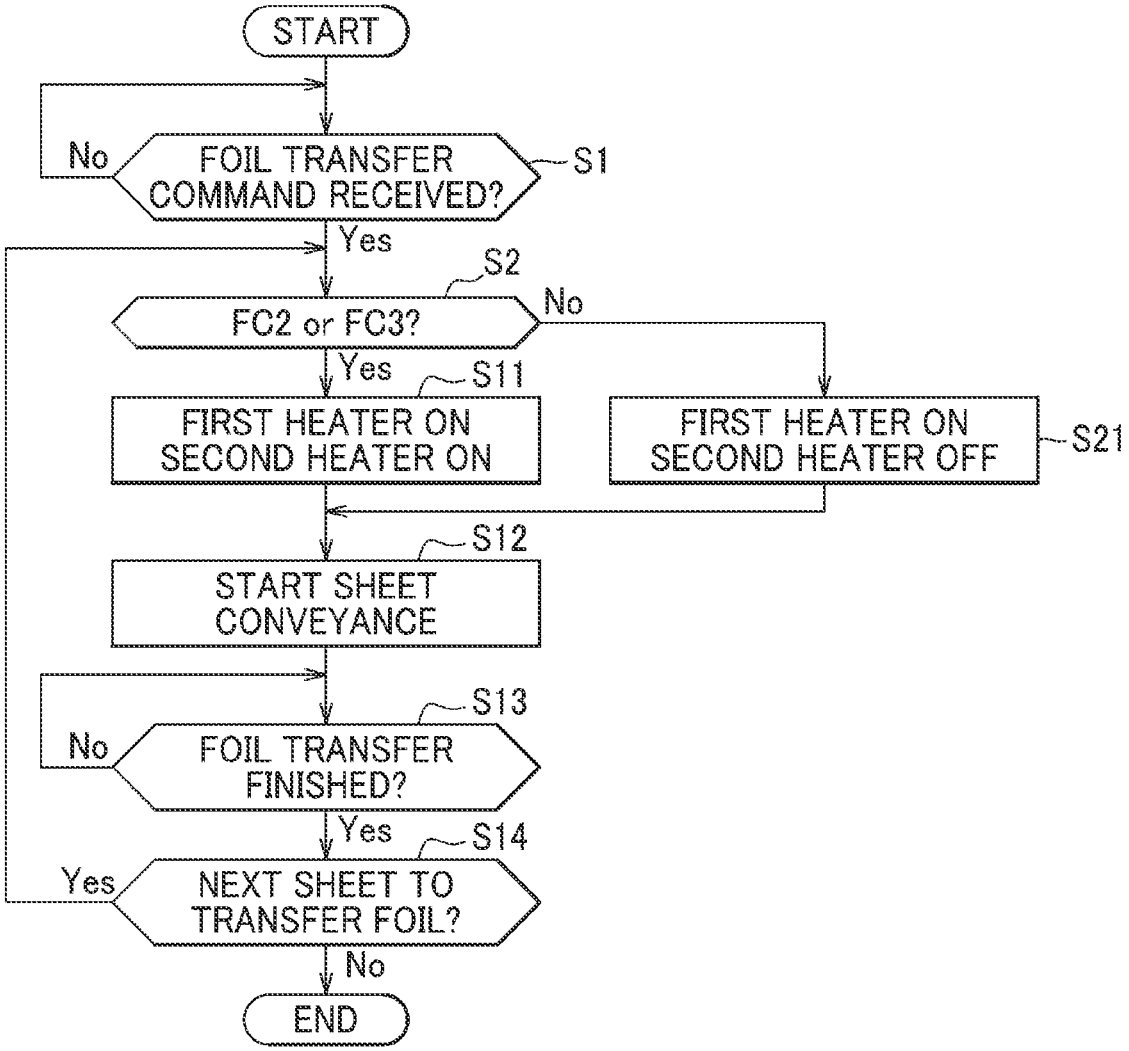

FIG. 11 is a table for determining a type of a foil transfer film cartridge.

FIG. 12 is a flowchart showing a process executed by a controller.

Figure 13A:
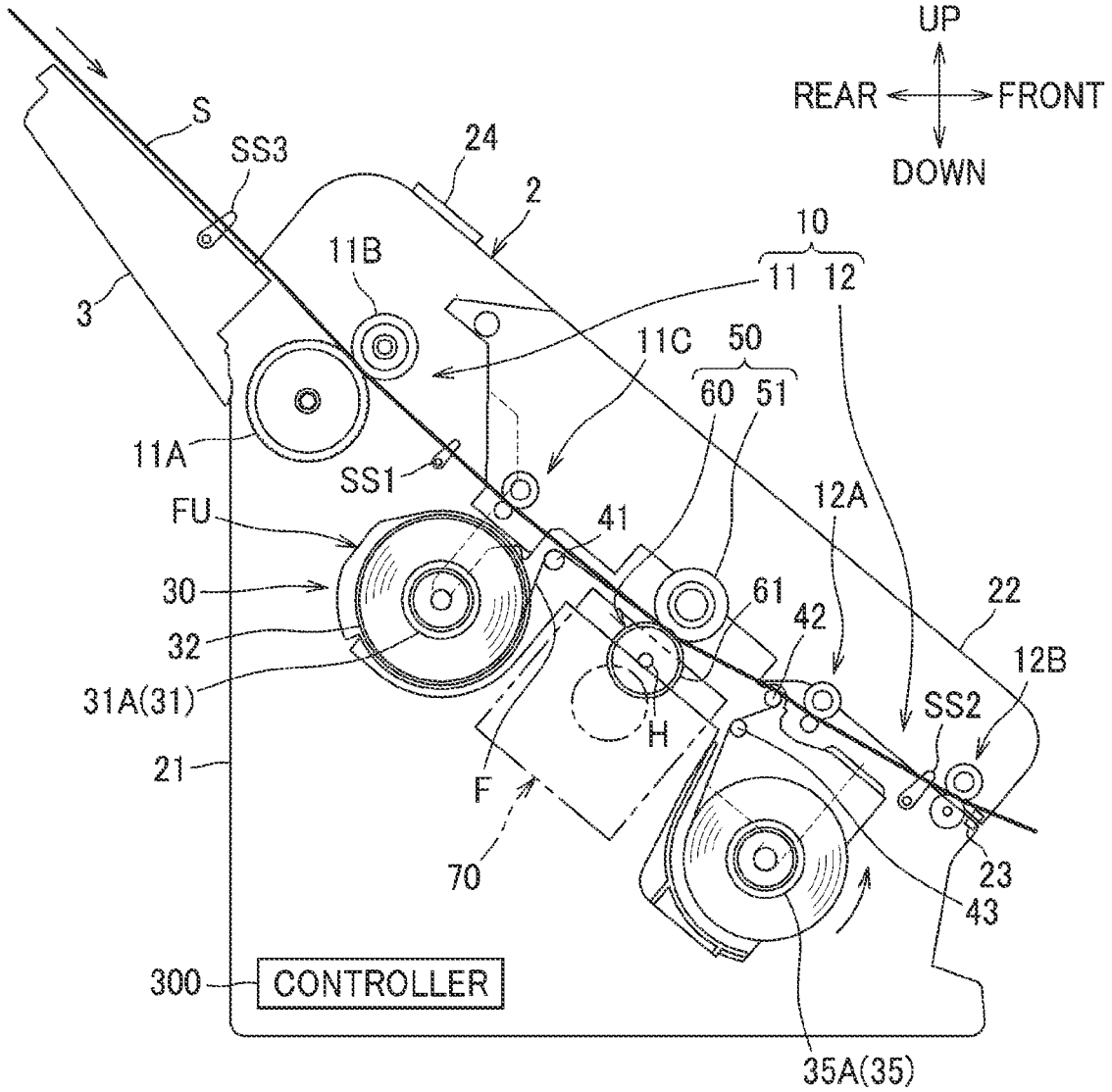

FIG. 13A is an illustration showing a second example of a foil transfer device.

Figure 13B:
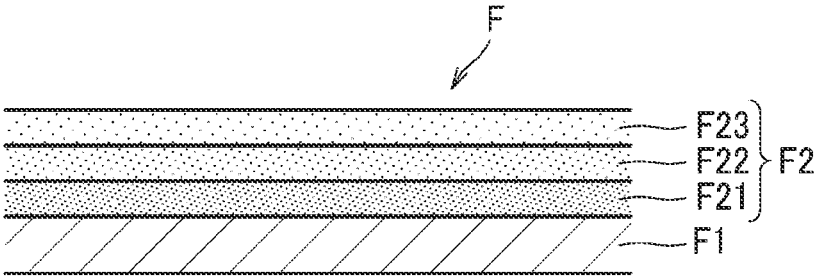

FIG. 13B is a section view showing a configuration of a foil film.

Figure 14:
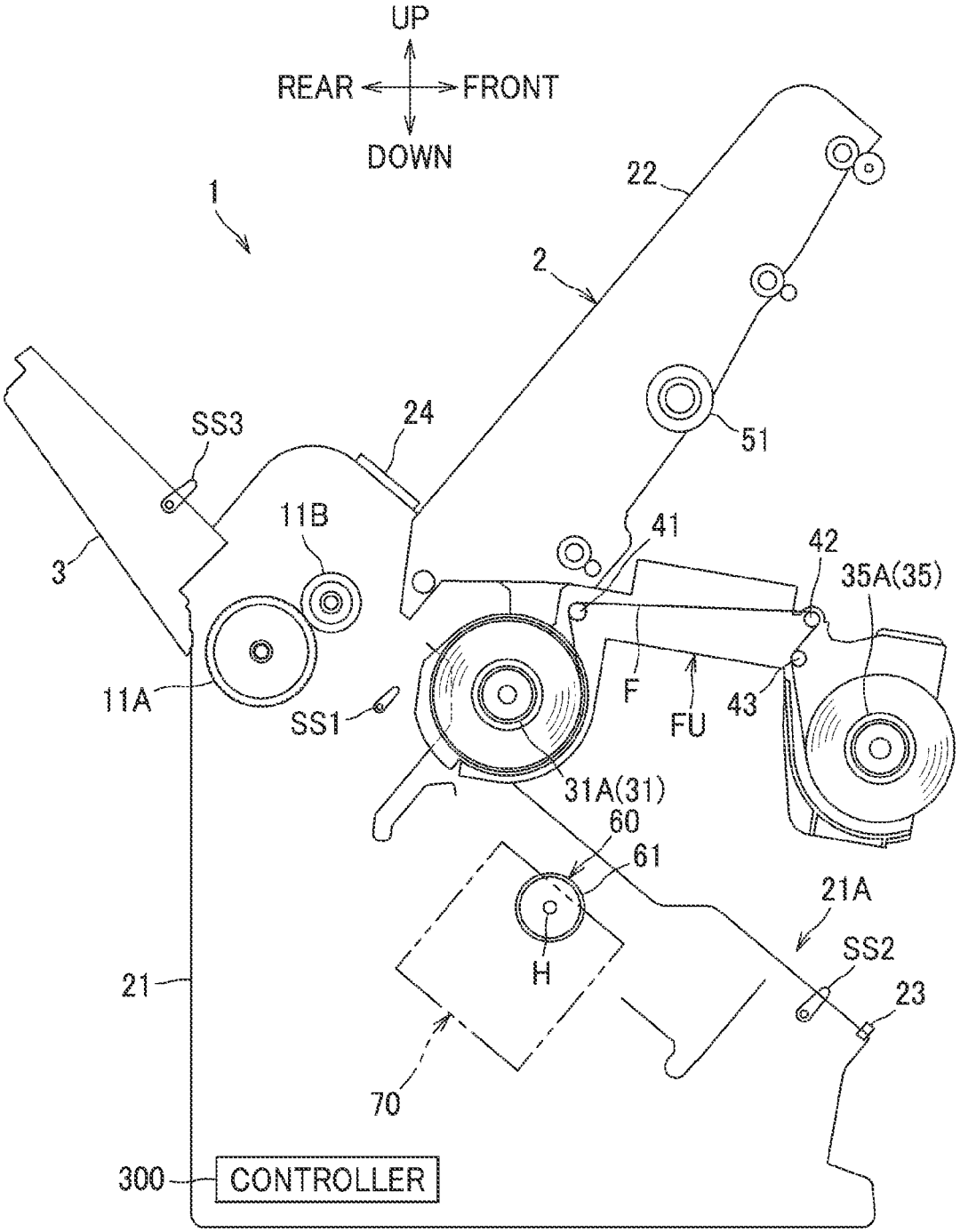

FIG. 14 is an illustration showing the foil transfer device with a cover open.

Figure 15:
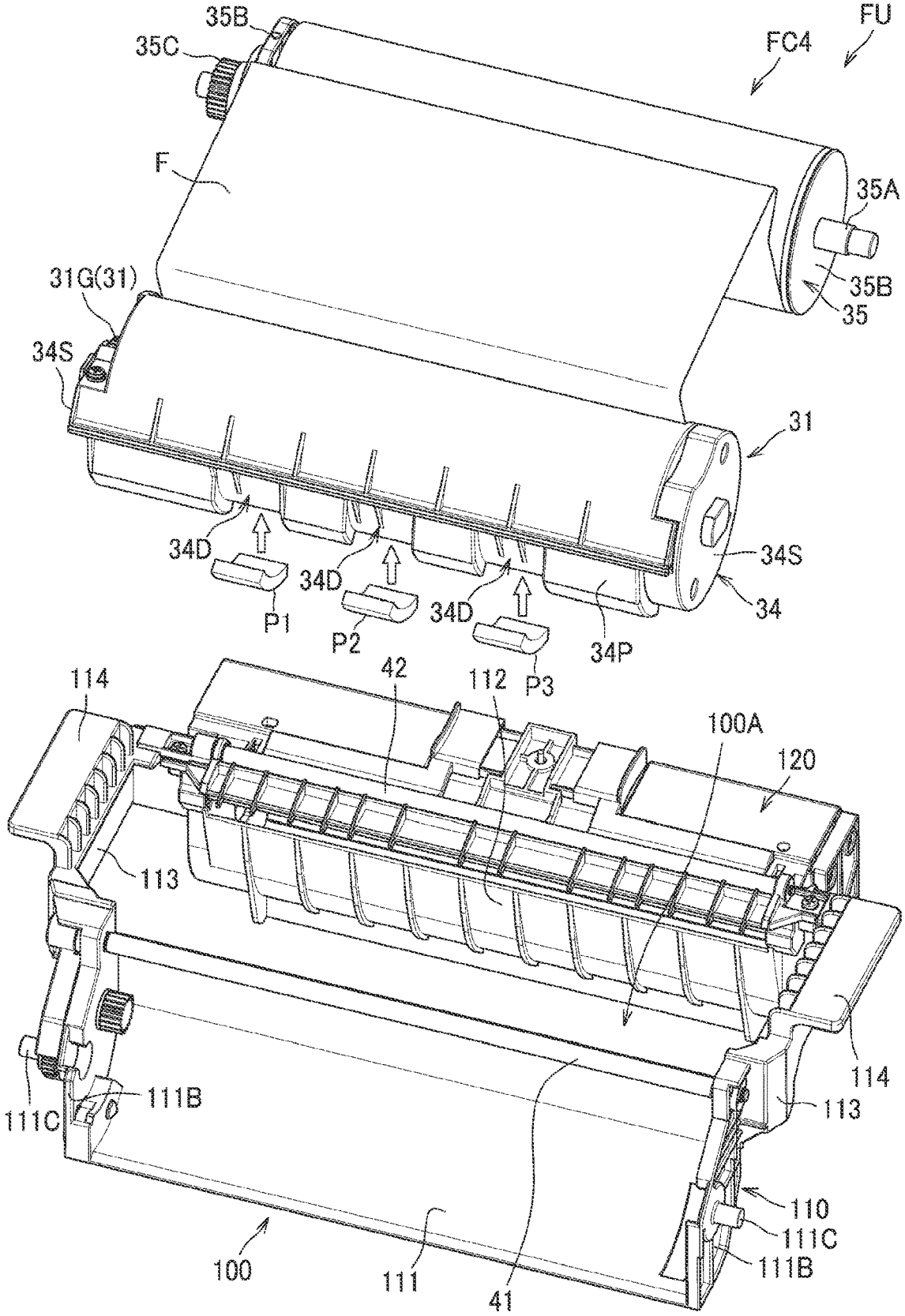

FIG. 15 is a exploded perspective view of a film unit.

Figure 16A:
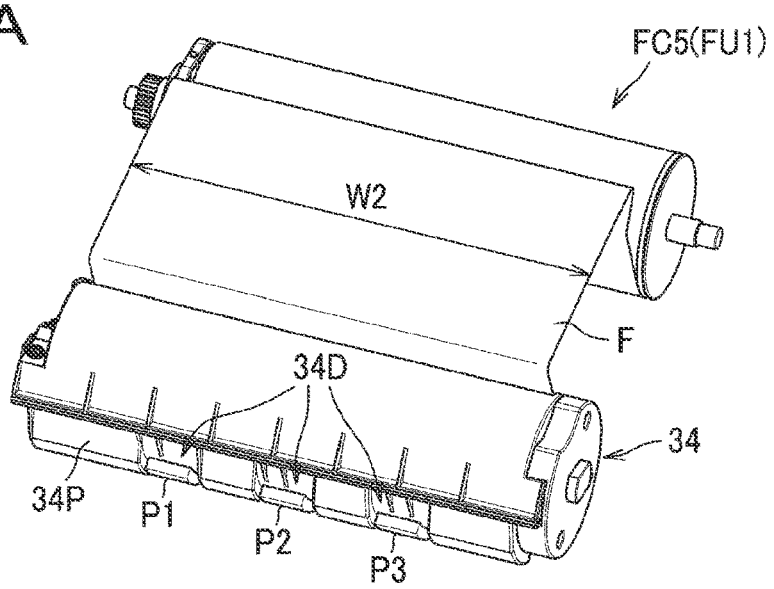

FIG. 16A is a perspective view of a first film cartridge.

Figure 16B:
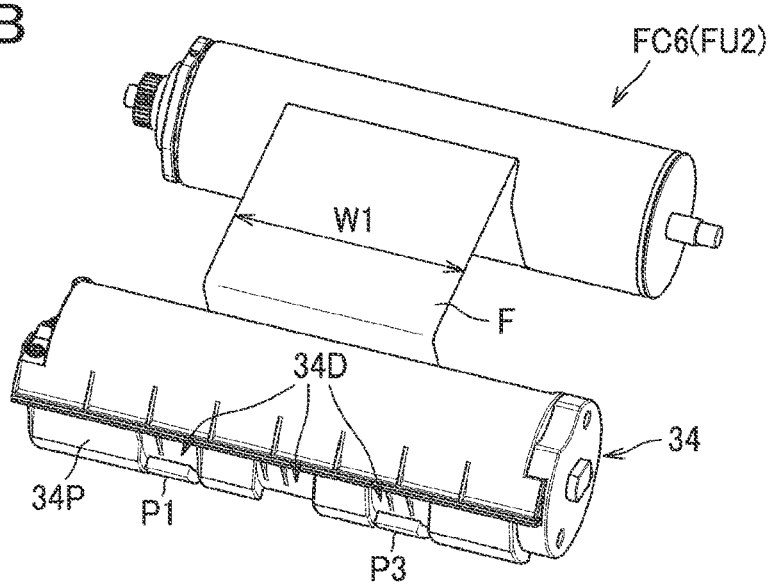

FIG. 16B is a perspective view of a second film cartridge.

Figure 16C:
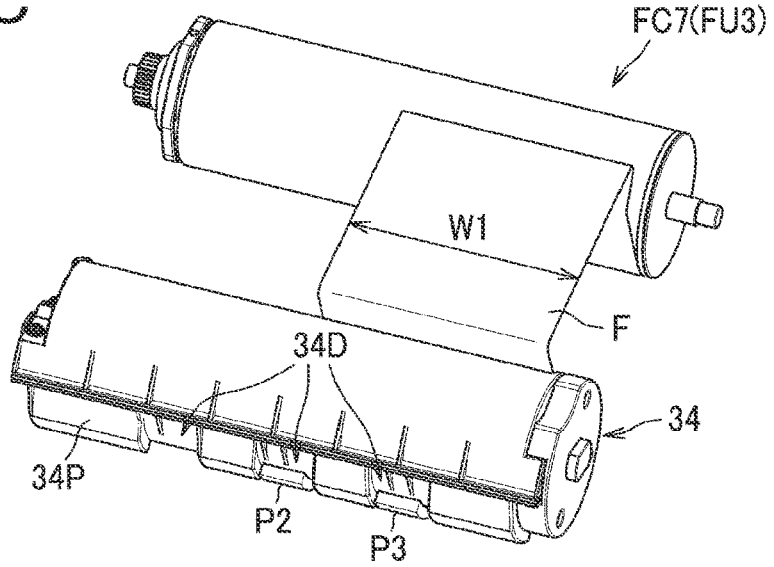

FIG. 16C is a perspective view of a third film cartridge.

FIG. 17A is an illustration showing three film sensors.

FIG. 17B is a table showing detection results of the sensors.

FIG. 18 is an illustration showing the location of sheet sensors located in a conveyance path of a sheet.

Figure 19:
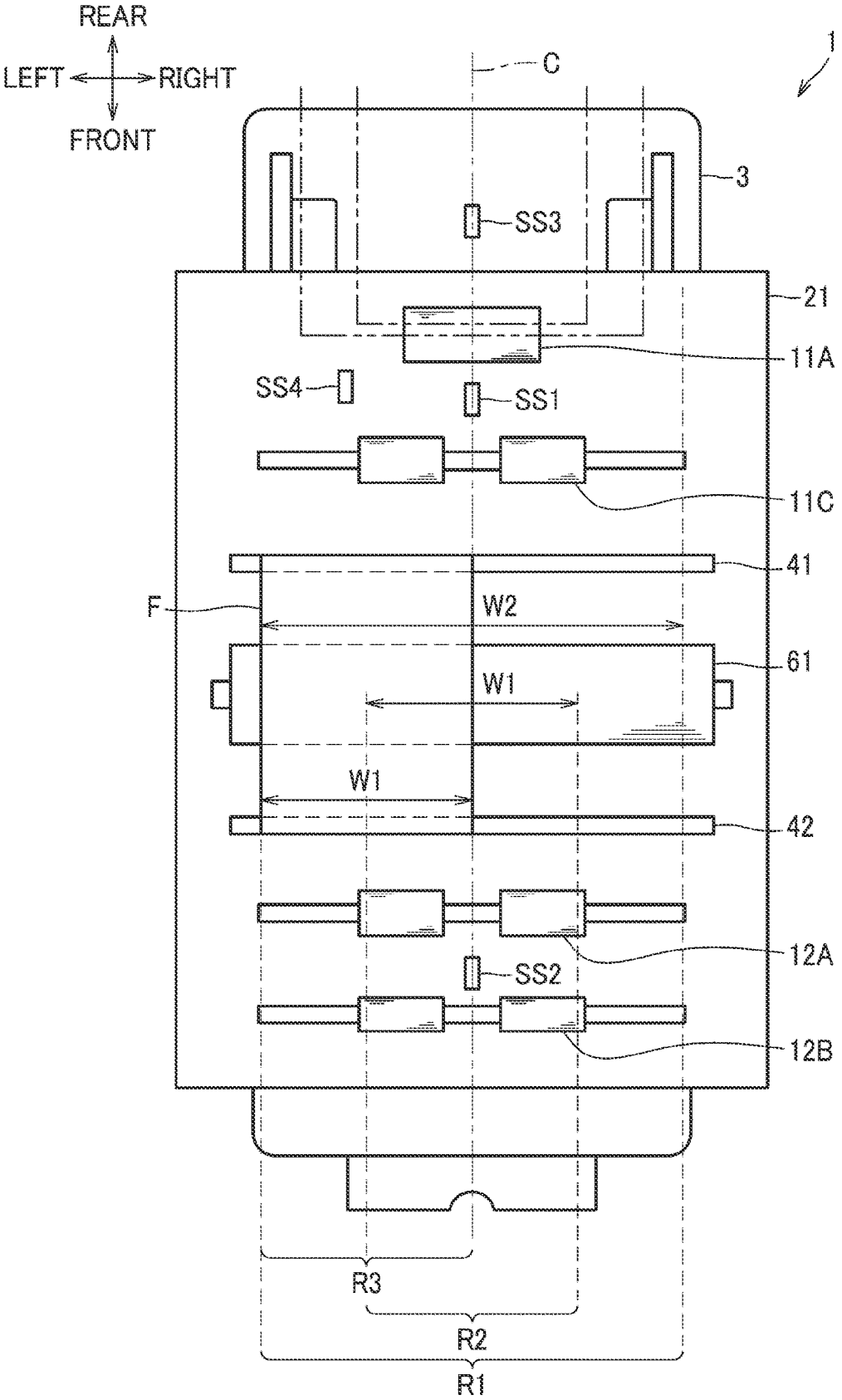

FIG. 19 is a view of the foil transfer device from above that shows the locations of a foil film, each of the sheet sensors, a supply roller and a conveyer roller.

Figure 20:
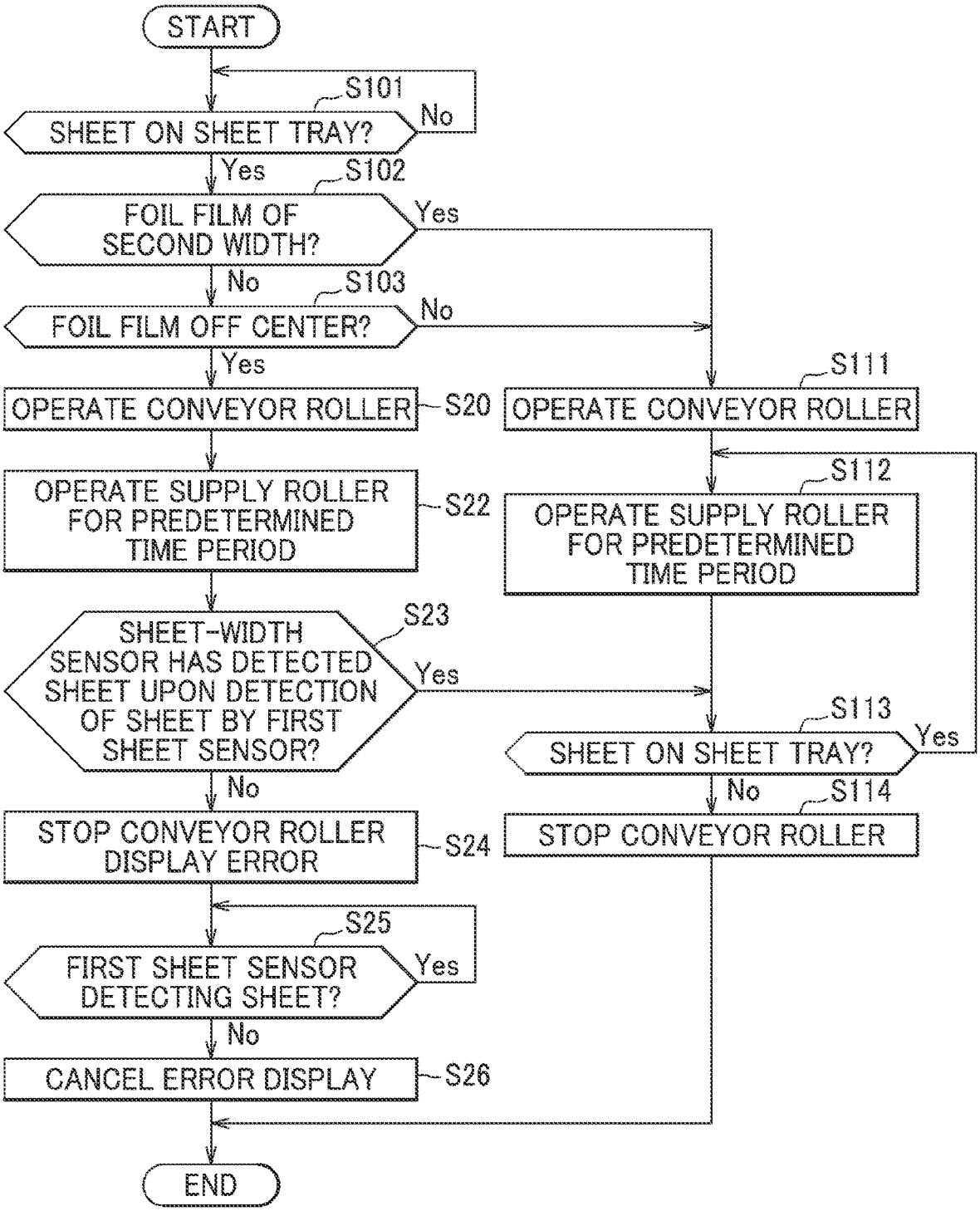

FIG. 20 is a flowchart showing a process executed by the controller.

Figure 21:
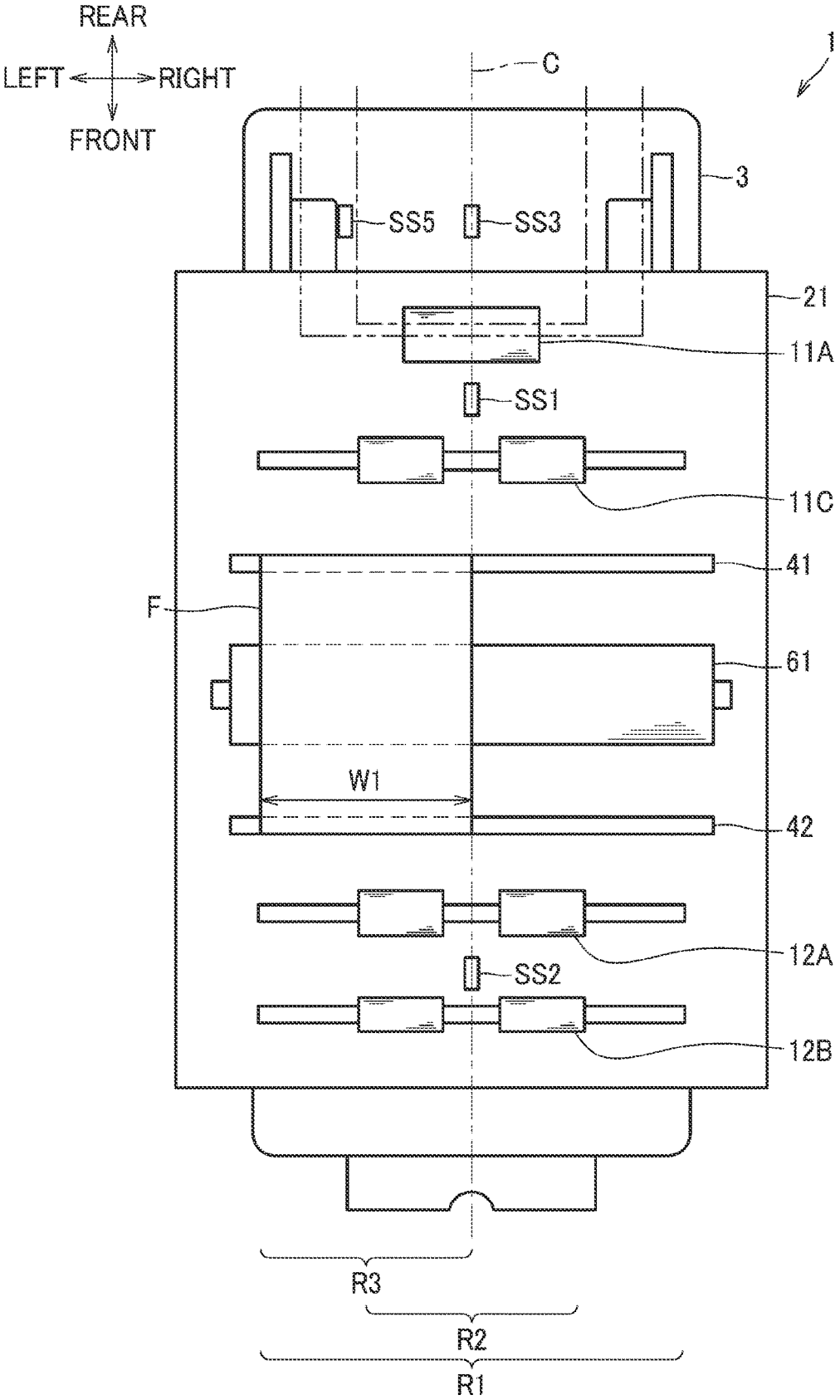

FIG. 21 is an illustration corresponding to FIG. 19 showing a third example of a foil transfer device.

Figure 22:
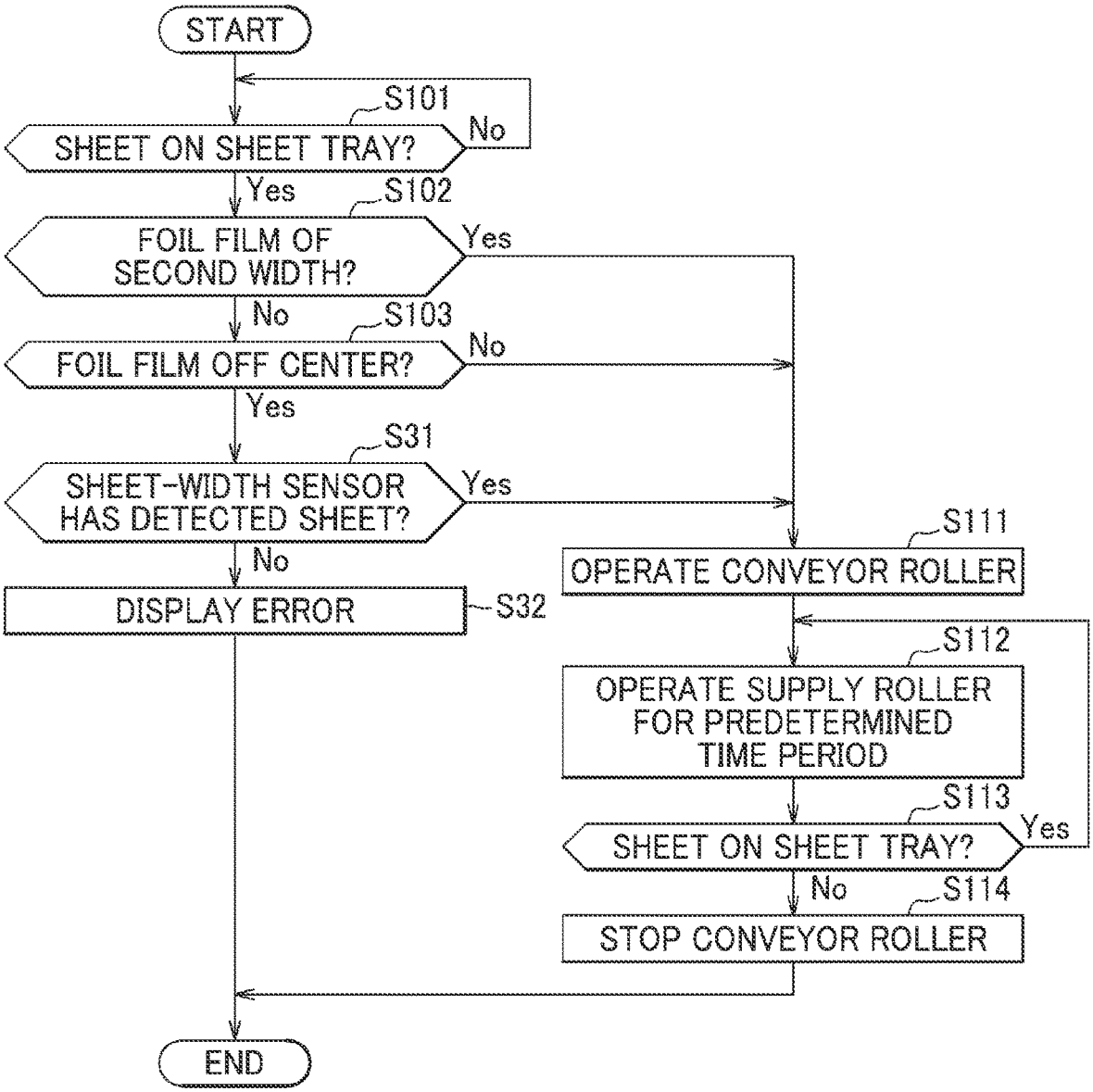

FIG. 22 is a flowchart showing a process executed by the controller according to the third example.

A detailed description will be given of an example of a foil transfer device 1 with reference made to the drawings where appropriate.

In the following description, directions will be explained by the directions shown in FIG. 1. That is, the right side of FIG. 1 will be referred to as "front", the left side of FIG. 1 will be referred to as "rear", the forward side of the sheet of FIG. 1 will be referred to as "left", and the rearside of the sheet of FIG. 1 will be referred to as "right". Upward and downward in FIG. 1 will be referred to as "up and down (upward and downward)".

Figure 1:
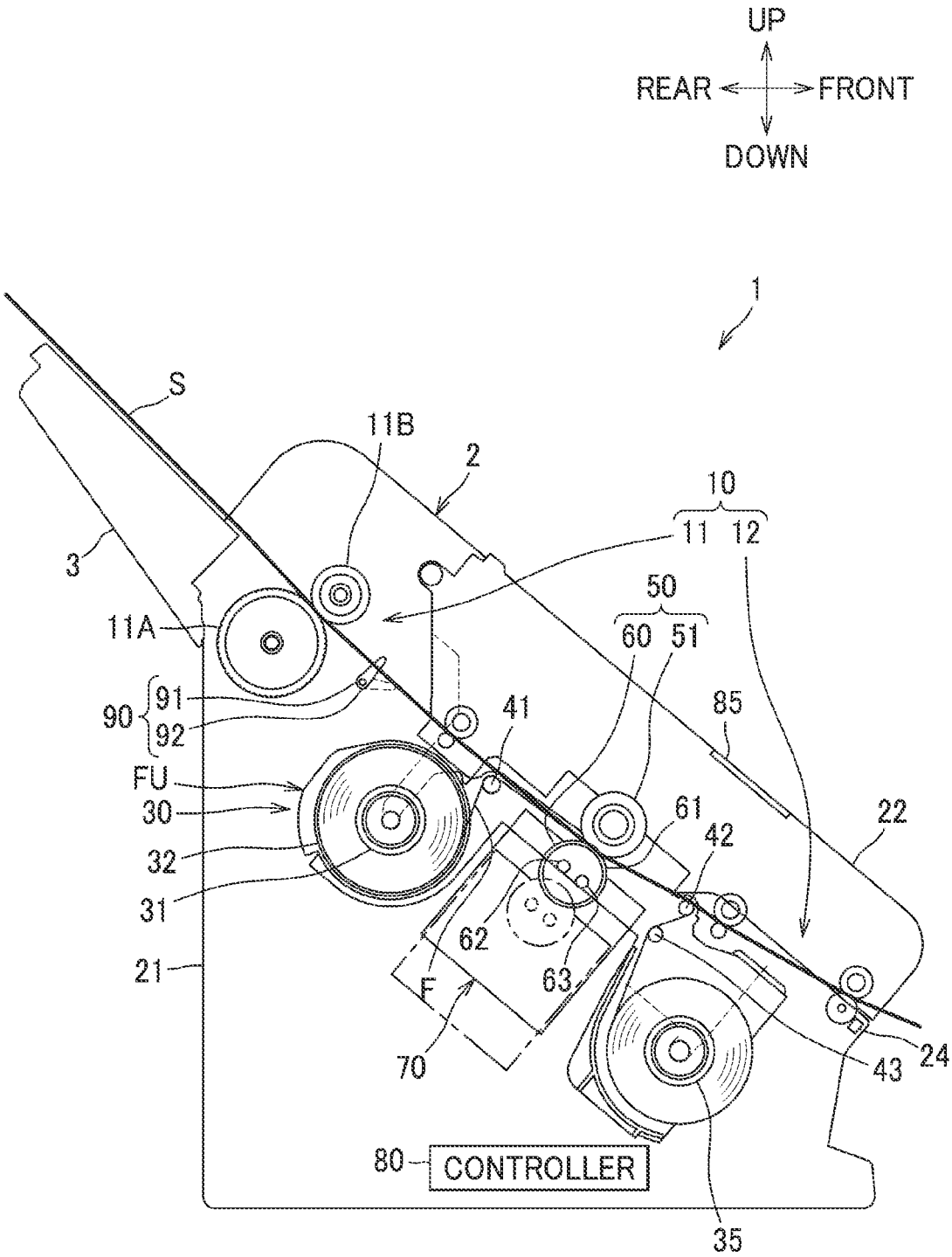
FIG. 1 is an illustration showing a foil transfer device.

As shown in FIG. 1, a foil transfer device 1 is capable of performing a foil transfer process in which after a toner image is formed on a sheet S in an image forming device such as, for example, a laser printer or the like, a foil film F comprised of a plurality of layers is laid on a surface of the sheet on which the toner image is formed and at least one layer of the foil film F is transferred onto the toner image. The foil transfer device 1 comprises a housing 2, a sheet tray 3, a sheet conveyor unit 10, a film supply unit 30, a transfer unit 50, and a controller 80.

The housing 2 is made of plastic or the like, and comprises a housing main body 21 and a cover 22.

The housing main body 21 has an opening 21A (see FIG. 2) at an upper portion thereof. The opening 21A has a dimension that allows a film unit FU which will be described below to pass therethrough.

The housing main body 21 includes a first holder GD1 and a second holder GD2 that holds the film unit FU and allows the film unit FU to be installed into and removed from the housing main body 21.

The cover 22 is a member for opening and closing the opening 21A. A rear end of the cover 22 is rotatably supported by the housing main body 21. The cover 22 is rotatable between a close position for closing the opening 21A (position in FIG. 1) and an open position for opening the opening 21A (position in FIG. 2).

The sheet tray 3 is a tray on which sheets S of paper, OHP film, etc. are placed. The sheet tray 3 is provided at a rear part of the housing 2. Each sheet S is placed on the sheet tray 3 with a surface on which a toner image is formed facing downward.

The sheet conveyor unit 10 comprises a sheet feed mechanism 11 and a sheet ejection mechanism 12. The sheet feed mechanism 11 is a mechanism that conveys sheets S on the sheet tray 3 one by one toward the transfer unit 50. The sheet feed mechanism 11 includes a supply roller 11A and a retard roller 11B. The supply roller 11A conveys a sheet S on the sheet tray 3 toward the transfer unit 50. The retard roller 11B is opposed to the supply roller 11A. The retard roller 11B rotates in such a direction as to move a sheet back to separate the sheets S one from others.

The sheet ejection mechanism 12 is a mechanism that ejects a sheet S having passed through the transfer unit 50, to the outside of the housing 2. The sheet ejection mechanism 12 includes a plurality of conveyor rollers.

The film supply unit 30 is a unit that supplies and lays the foil film F onto a sheet S conveyed from the sheet feed mechanism 11. The film supply unit 30 comprises the film unit FU, and a drive source such as a motor or the like (not shown).

Figure 2:
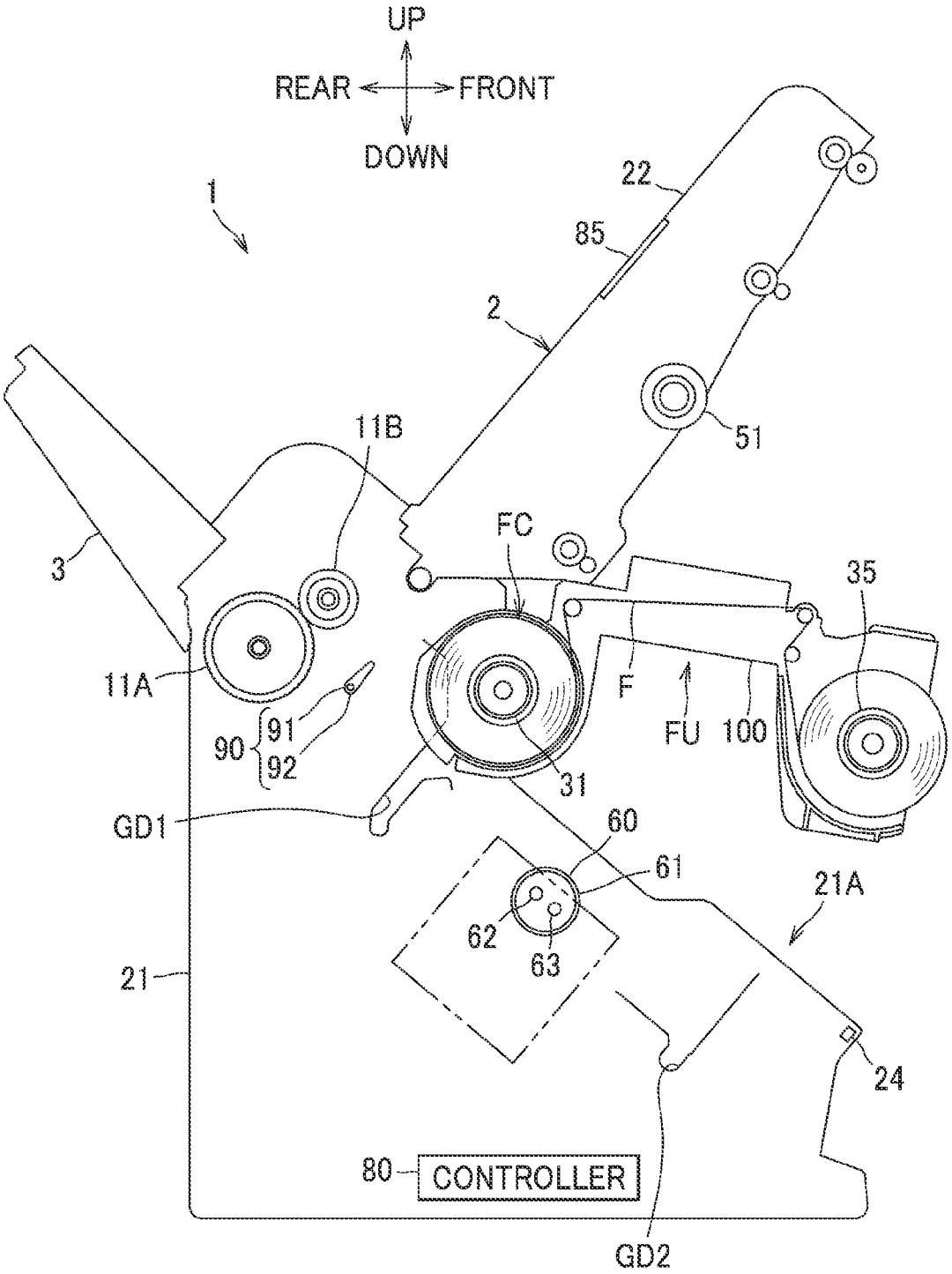
FIG. 2 is an illustration showing the foil transfer device with a cover open.

The film unit FU is configured, as shown in FIG. 2, to be installable into and removable from the housing main body 21 through the opening 21A in a direction perpendicular to an axial direction of a supply reel 31 which will be described below. As shown in FIG. 1, the film unit FU comprises the supply reel 31, a take-up reel 35, a first guide shaft 41, a second guide shaft 42, and a third guide shaft 43. The foil film F is wound on the supply reel 31.

The foil film F is a film comprised of a plurality of layers. Specifically, the foil film F includes a supporting layer and a supported layer. The supporting layer is a transparent substrate in the form of a tape made of polymeric material and supports the supported layer. The supported layer includes, for example, a release layer, a transfer layer, and an adhesive layer. The release layer is a layer for facilitating separation of the transfer layer from the supporting layer, and is interposed between the supporting layer and the transfer layer.

The transfer layer is a layer to be transferred onto a toner image, and contains foil. Foil is a thin sheet of metal such as gold, silver, copper, aluminum, etc. The transfer layer is interposed between the release layer and the adhesive layer. The adhesive layer is a layer for facilitating adhesion of the transfer layer to a toner image.

One end of the foil film F is fixed to the supply reel 31.

The take-up reel 35 is a member for taking up the foil film F. The other end of the foil film F is fixed to the take-up reel 35.

It is to be understood that in FIG. 1 and other figures, the foil film F is shown as to be wound on both of the supply reel 31 and the take-up reel 35 in a roll of a maximum diameter for the sake of convenience. In actuality, the film unit FU in a new condition has its foil film F wound on the supply reel 31 in a roll of a maximum diameter, while no foil film F is wound on the take-up reel 35, or the foil film F is wound on the take-up reel 35 in a roll of a minimum diameter. When the film unit FU is at the end of its life (the foil film F has been exhausted), the foil film F is wound on the take-up reel 35 in a roll of a maximum diameter, while no foil film F is wound on the supply reel 31, or the foil film F is wound on the supply reel 31 in a roll of a minimum diameter.

The first guide shaft 41 is a shaft for changing the traveling direction of the foil film F drawn out from the supply reel 31.

The second guide shaft 42 is a shaft for changing the traveling direction of the foil film F guided by the first guide shaft 41.

The third guide shaft 43 is a shaft for changing the traveling direction of the foil film F guided by the second guide shaft 42 and for guiding the foil film F to the take-up reel 35.

When the film unit FU is set in the foil transfer device 1 by installing the film unit FU in the housing main body 21, the take-up reel 35 is driven to rotate in a counterclockwise direction in the drawings by the drive source (not shown) provided in the housing 2. When the take-up reel 35 rotates, the foil film F wound around the supply reel 31 is drawn out, and the drawn-out foil film F is taken up on the take-up reel 35. Specifically, in the foil transfer process, the foil film F is drawn out from the supply reel 31 as the foil film F is conveyed forward by a pressure roller 51 and a heating member 61 which will be described below. The foil film F conveyed forward by the pressure roller 51 and the heating member 61 is taken up on the take-up reel 35.

The first guide shaft 41 guides the foil film F drawn out from the supply reel 31 in such a manner that the foil film F is laid under a sheet S being conveyed with a surface having a toner image formed thereon facing downward. The first guide shaft 41 changes a direction of conveyance of the foil film F drawn out from the supply reel 31, and guides the foil film F in a direction approximately parallel to a direction of conveyance of the sheet S.

The second guide shaft 42 contacts the foil film F having passed through the transfer unit 50, and changes a direction of conveyance of the foil film F having passed through the transfer unit 50 to a direction different from a direction of conveyance of a sheet S. The foil film F having passed through the transfer unit 50 and conveyed with the sheet S laid thereon is guided in a direction different from the direction of conveyance of the sheet S while passing the second guide shaft 42, and peeled off from the sheet S.

The transfer unit 50 is a unit that heats and applies pressure to a sheet S and the foil film F laid on each other, to transfer the transfer layer onto a toner image formed on the sheet S. The transfer unit 50 includes a pressure roller 51 and a heating portion 60. The transfer unit 50 applies heat and pressure to the sheet S and the foil film F laid on each other in a nip between the pressure roller 51 and the heating portion 60.

The pressure roller 51 is a roller comprising a cylindrical metal core with its cylindrical surface coated with a rubber layer made of silicone rubber. The pressure roller 51 is located above the foil film F, and is contactable with a reverse side (opposite to a side on which a toner image is formed) of the sheet S.

The pressure roller 51 has end portions rotatably supported by the cover 22. The pressure roller 51 nips the sheet S and the foil film F in combination with the heating member 61, and is driven to rotate by the drive source (not shown), causing the heating roller 61 to rotate in accordance with the pressure roller 51.

Figure 3:
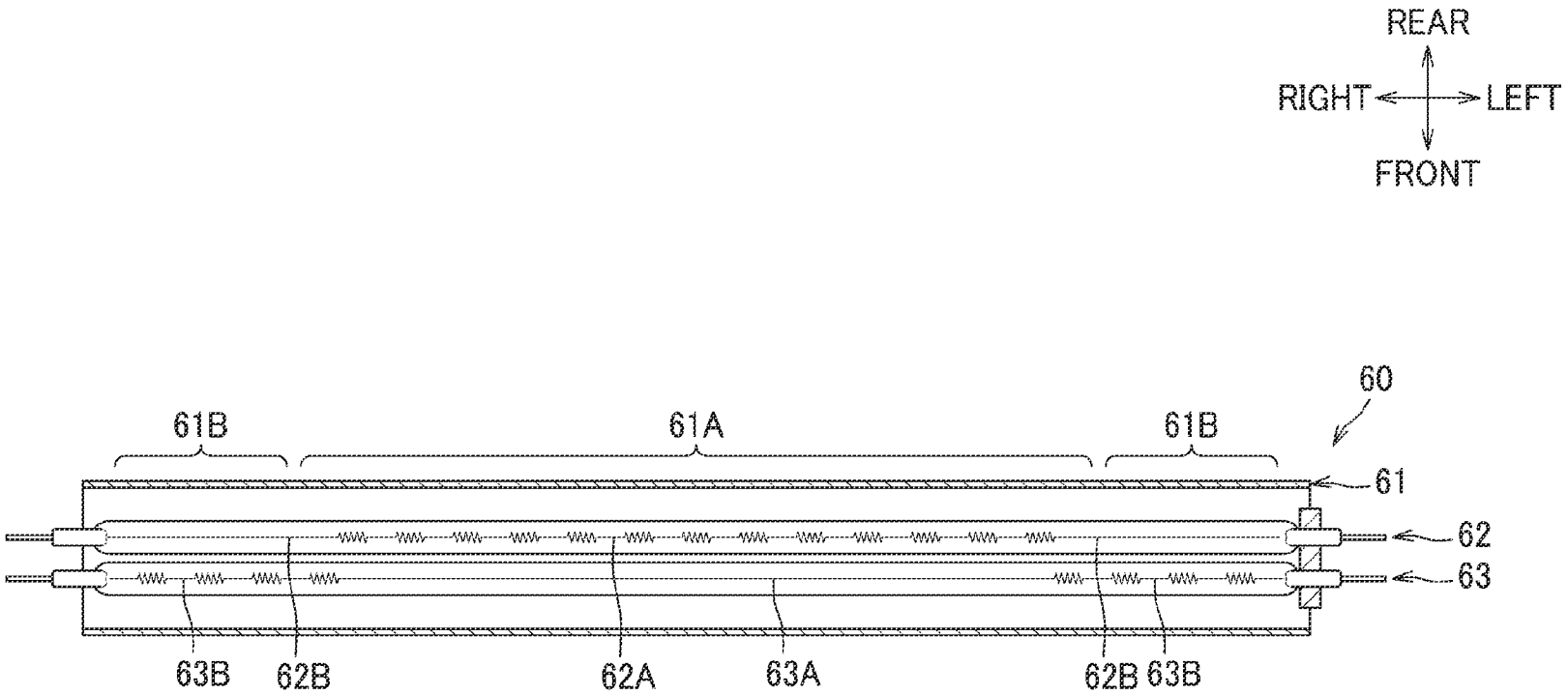
FIG. 3 is a section view of a heating portion.

The heating portion 60 is a member located under the foil film F and contacts the foil film F to heat the foil film F and the sheet S. The heating portion 60 extends in a widthwise direction of the foil film F (referred to simply as "widthwise direction" in the following description) perpendicular to a direction of conveyance of the foil film F. As shown in FIG. 3, the heating portion 60 includes the heating member 61, a first heater 62, and a second heater 63.

The heating member 61 is a roller comprised of a metal tube formed in a cylindrical shape. The heating member 61 is a member that contacts the foil film F to heat the foil film F and the sheet S.

The first heater 62 heats the heating member 61. The first heater 62 has a power output at a center portion 62A in the widthwise direction higher than a power output at each end portion 62B in the widthwise direction. Thus, the first heater 62 heats a first portion 61A which is a center portion of the heating member 61 in the widthwise direction, at an intensity higher than an intensity at which the first heater 62 heats second portions 61B which are end portions of the heating member 61 in the widthwise direction. The first portion 61A and the second portions 61B of the heating member 61 are arranged side by side in the widthwise direction. In this example, a width of the first portion 61A is 150 to 180 mm, and it is possible to heat an A5 size sheet S by the first heater 62 alone.

The second heater 63 heats the heating member 61. The second heater 63 has a power output at each end portion 63B in the widthwise direction higher than a power output at a center portion 63A in the widthwise direction. Thus, the second heater 63 heats the second portions 61B of the heating member 61, at an intensity higher than an intensity at which the second heater 63 heats the first portion 61A of the heating member 61.

Figures 4A, 4B:
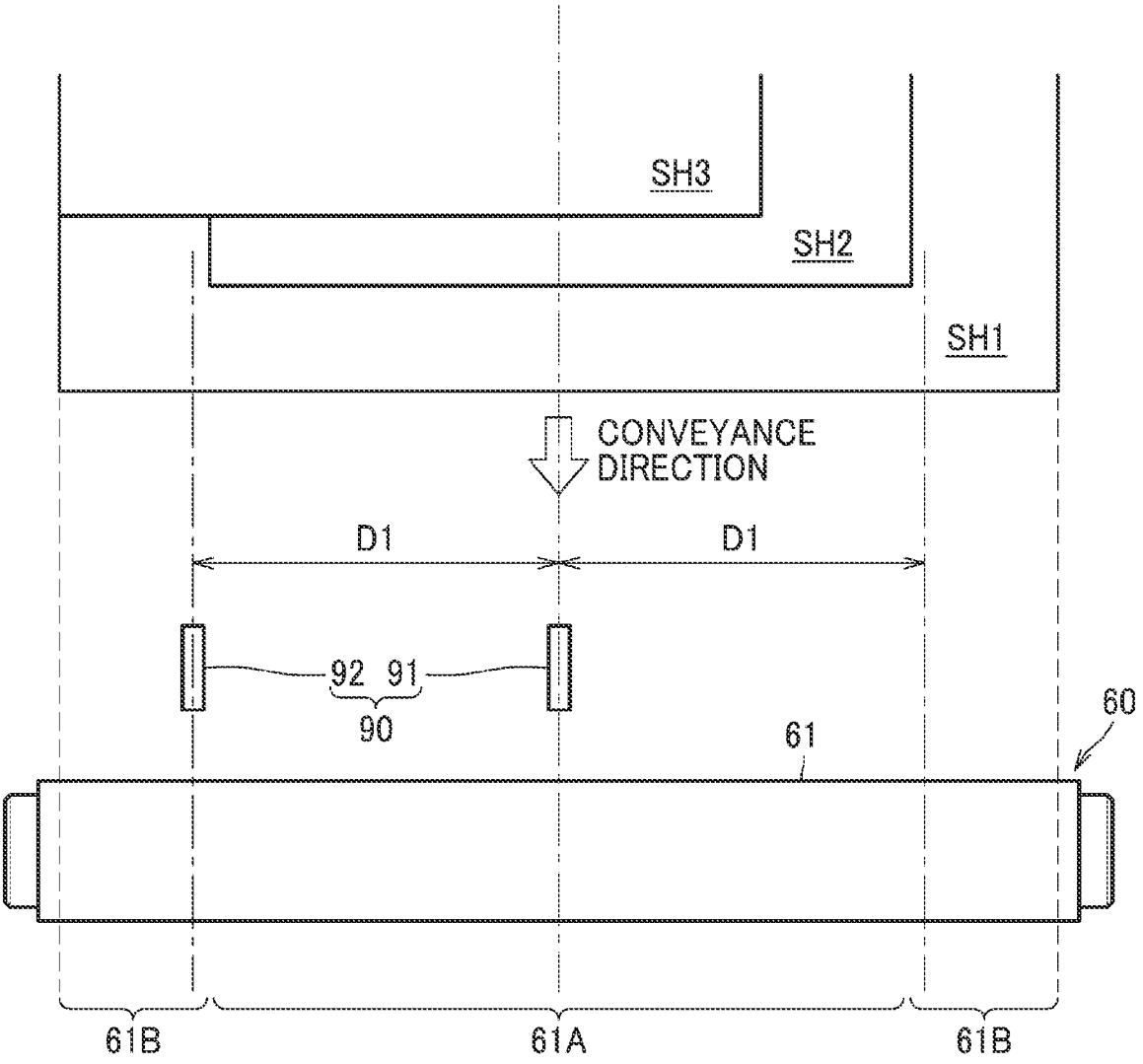
FIG. 4A is an illustration showing positions of sheet sensors in a conveyance path of a sheet.
FIG. 4B is a table showing determination results of the sheet sensors for each sheet.

As shown in FIG. 4A, the foil transfer device 1 further comprises a sheet sensor 90 that detects a sheet S passing thereby. The sheet sensor 90 is located upstream of the heating portion 60 in the direction of conveyance of a sheet S. The sheet sensor 90 includes a center sheet sensor 91 and a side sheet sensor 92. The center sheet sensor 91 and the side sheet sensor 92 are swingably supported by the housing main body 21. The center sheet sensor 91 and the side sheet sensor 92 swing and turn on upon contacting a sheet S (see FIG. 1).

The center sheet sensor 91 is located at a position corresponding to the first portion 61A of the heating member 61. The center sheet sensor 91 can detect whether or not a sheet S passes over a surface of the first portion 61A. In this example, the center sheet sensor 91 is located in the center of a conveyance path of the sheet S in the widthwise direction.

The side sheet sensor 92 is located at a position corresponding to the second portion 61B of the heating member 61. The side sheet sensor 92 can detect whether or not a sheet S passes over a surface of the second portion 61B. In this example, the side sheet sensor 92 is located apart by a distance D1, specifically 75 to 80 mm apart, from the center of the conveyance path of the sheet S in the widthwise direction.

As shown in FIGS. 4A, 4B, if the sheet S is a sheet SH1 that passes over the surfaces of the first portion 61A and the second portions 61B on both sides of the first portion 61A, both of the center sheet sensor 91 and the side sheet sensor 92 turn on. The sheet SH1 is, for example, an A4 size sheet (with a width of 210 mm) or a letter size sheet (with a width of 215.9 mm).

If the sheet S is a sheet SH2 that passes over the surface of the first portion 61A, but does not pass over the surfaces of the second portions 61B, only the center sheet sensor 91 turns on. The sheet SH2 is, for example, an A5 size sheet (148 mm) or a A6 size sheet (105 mm) located in the center.

If the sheet S is a sheet SH3 that passes over the first portion 61A and one of the second portions 61B, both of the center sheet sensor 91 and the side sheet sensor 92 are turned on. The sheet SH3 is, for example, an A5 size sheet (148 mm) or an A6 size sheet (105 mm) shifted to one side.

Referring back to FIG. 1, the foil transfer device 1 comprises a contact/separation mechanism 70 which causes at least one of the heating portion 60 and the pressure roller 51 to move between a contact position in which the pressure roller 51 applies pressure to the heating portion 60 and a separate position in which the heating portion 60 and the pressure roller 51 are separated. In this example, the contact/separation mechanism 70 moves the heating portion 60 between the contact position and the separate position.

When the cover 22 is open or when no foil transfer process is executed on a sheet S in the transfer unit 50, the heating portion 60 is positioned in the separate position separated from the foil film F. When a foil transfer control process is executed with the cover 22 closed, the controller 80 controls the contact/separation mechanism 70 to cause the heating portion 60 to move to the contact position in which the heating portion 60 is in contact with the foil film F.

The controller 80 comprises a CPU, a ROM, a RAM, a nonvolatile memory, etc., and is configured to execute various kinds of control based on programs provided in advance. The ROM, the RAM, the nonvolatile memory, etc. stores, for example, an optimal control table for an installed foil film F as data necessary for the foil transfer control process. For example, when a user operates an operation panel 85 provided on the cover 22 of the housing 2 to transfer foil on a sheet S, the controller 80 receives a signal from the operation panel 85 and executes the foil transfer control process.

With the foil transfer device 1 configured as described above, when foil is transferred, sheets S placed on the sheet tray 3 with front surfaces facing downward are conveyed one by one by the sheet feed mechanism 11 toward the transfer unit 50. The sheet S is laid on a foil film F supplied from the supply reel 31 at a position upstream of the transfer unit 50 in the conveyance direction of the sheet, and conveyed to the transfer unit 50 with a toner image of the sheet S being kept in contact with the foil film F.

In the transfer unit 50, the heating portion 60 and the pressure roller 51 apply heat and pressure to the sheet S and the foil film F passing through the nip between the pressure roller 51 and the heating portion 60, so that foil is transferred onto the toner image.

After foil is transferred, the sheet S and the foil film F adhered to each other are conveyed to the second guide shaft 42. When the sheet S and the foil film F travel past the second guide shaft 42, the direction of conveyance of the foil film F is changed to a direction different from the direction of conveyance of the sheet S; thereby the foil film F is peeled off from the sheet S.

The foil film F peeled off from the sheet S is taken up on the take-up reel 35. On the other hand, the sheet S from which the foil film F is peeled off is ejected to the outside of the housing 2 by the sheet ejection mechanism with a foil transferred surface facing downward.

Next, the film unit FU will be described in detail.

As shown in FIG. 2, the film unit FU comprises a holder 100 made of plastic or the like, and a foil transfer film cartridge FC installable into and removable from the holder 100. The foil transfer film cartridge FC comprises the supply reel 31 and the take-up reel 35 described above. The foil transfer film cartridge FC is installable into and removable from the housing main body 21 in a state where the foil transfer film cartridge FC is attached to the holder 100. In the following description, the foil transfer film cartridge FC being installed into and removed from the housing main body 21 with the holder 100 is also referred to simply as "the foil transfer film cartridge FC being installed into and removed from the housing main body 21".

Figure 5:
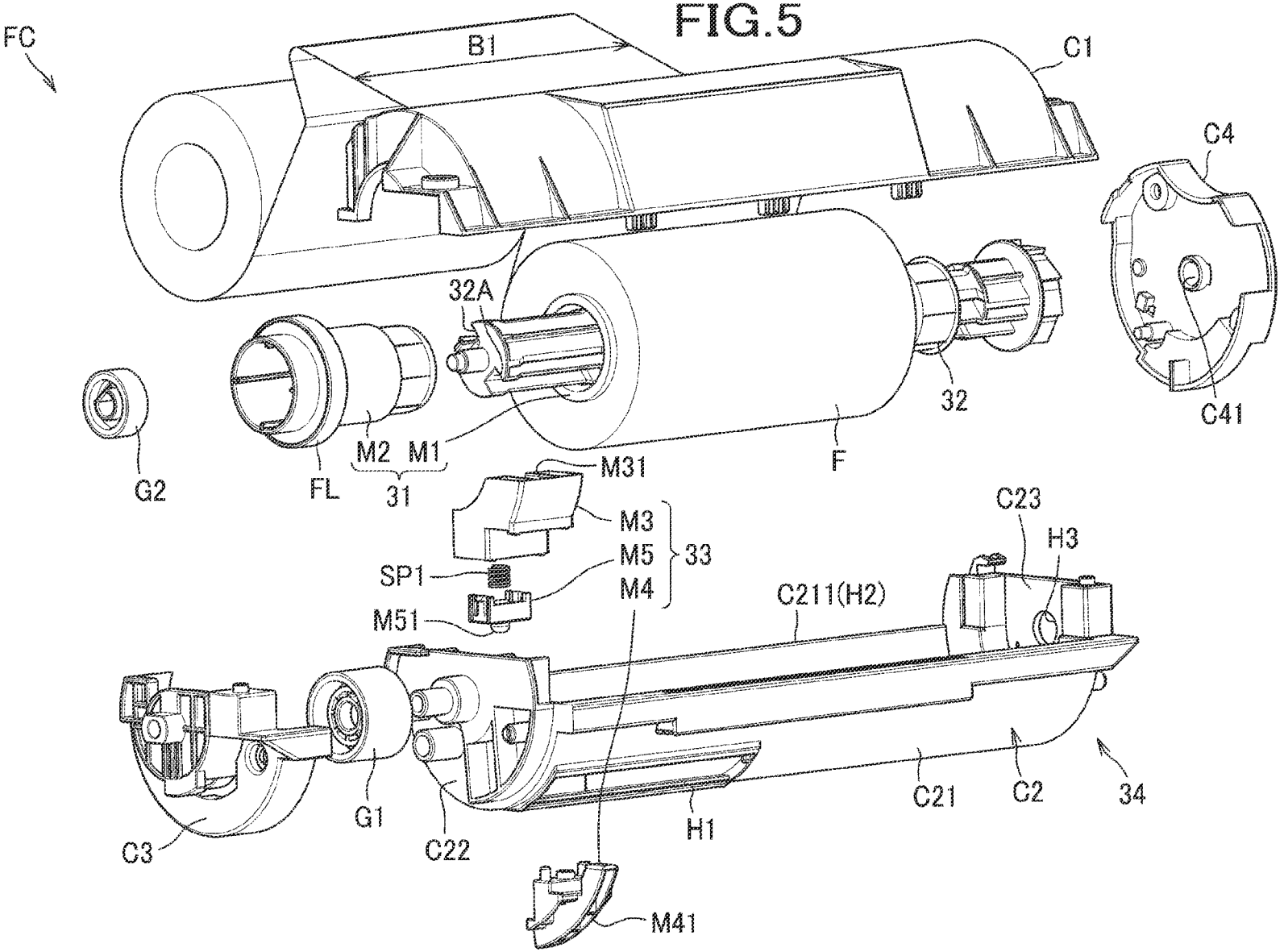
FIG. 5 is an exploded perspective view of a foil transfer film cartridge showing supply-reel-side structures.

As shown in FIG. 5, the foil transfer film cartridge FC comprises the supply reel 31, a supply shaft 32, a lever 33, and a supply case 34. The supply reel 31, the supply shaft 32, the lever 33, and the supply case 34 are made of plastic or the like. The supply reel 31 includes a first member M1 and a second member M2.

The first member M1 is an approximately cylindrical member. A foil film having a widthwise dimension of a first width B1 is wound on the first member M1.

The second member M2 is an approximately cylindrical member. The second member M2 is fitted into an opening formed in one axial end of the first member M1, and thereby rotates together with the first member M1. The second member M2 has a flange FL at one axial end, specifically, an end opposite to the end at which the first member M1 is located. In other words, the flange FL is located at one axial end of the supply reel 31. The flange FL protrudes from an outer peripheral surface of the second member M2, and is formed in a shape of a ring extending circumferentially along the outer peripheral surface of the second member M2.

The supply shaft 32 is a shaft longer in the widthwise direction of the foil film F than the first width B1. Specifically, the supply shaft 32 is longer in the widthwise direction than the supply reel 31. The supply shaft 32 is allowed to pass through a hole formed in the supply reel 31. Specifically, the supply shaft 32 is configured to be located inside the first member M1 and the second member M2. The supply shaft 32 is engaged with the supply reel 31 in the circumferential direction of the supply shaft 32 so that the supply shaft 32 is capable of rotating together with the supply reel 31 including the flange FL.

Specifically, the supply shaft 32 has a groove 32A extending in the axial direction in an outer peripheral surface thereof. The supply reel 31 has, on an inner peripheral surface thereof, a protrusion (not shown) to be inserted in the groove 32A. When the protrusion is inserted into the groove 32A, the groove 32A and the protrusion engage with each other in the circumferential direction of the supply shaft 32; thus the supply shaft 32 and the supply reel 31 are rotatable together. With the protrusion being inserted into the groove 32A as described above, the supply shaft 32 supports the supply reel 31 in a manner that allows the supply reel 31 to move in the widthwise direction between a first position and a second position different from the first position.

The lever 33 is a member that engages with the supply reel 31 in the widthwise direction and moves together with the supply reel 31 in the widthwise direction. The lever 33 comprises a first lever member M3, a second lever member M4 and a third lever member M5.

The first lever member M3 has a groove M31 that engages with the flange FL in the widthwise direction. The groove M31 is configured not to engage with the flange FL in the direction of rotation of the flange FL. Specifically, the bottom surface of the groove M31 is located apart from the outer peripheral surface of the flange FL, and the side surfaces of the groove M31 are located on both sides of, and sandwich, the flange FL in the widthwise direction.

The second lever member M4 is a fan-shaped member having an outer peripheral surface M41 that extends along an outer peripheral surface of the supply case 34. The second lever member M4 is fixed to the first lever member M3.

The third lever member M5 is supported by the first lever member M3 in a manner that allows the third lever member M5 to move in a radial direction of the supply reel 31. A first protrusion M51 is formed on the third lever member M5. The first protrusion M51 forms a supply-position locating part for locating the supply reel 31 in a first position or a second position. A first spring SP1 that biases the first protrusion M51 outward in a radial direction of the supply case 34 is provided between the first lever member M3 and the third lever member M5.

The supply case 34 is a case which houses the supply reel 31. The supply case 34 comprises a first case member C1, a second case member C2, a third case member C3, and a fourth case member C4.

The first case member C1 and the second case member C2 are approximately hemicylindrical members. The second case member C2 has an outer peripheral wall C21, a first side wall C22, and a second side wall C23. The outer peripheral wall C21 has an opening H1 for exposing the second lever member M4 of the lever 33. One end C211 of the outer peripheral wall C21 in the circumferential direction forms an edge of a film opening H2 through which the foil film F passes.

Here, the film opening H2 is an opening formed as a rectangular hole long in the widthwise direction when the first case member C1 and the second case member C2 are assembled together. The film opening H2 has a length in the widthwise direction greater than the first width B1 to allow the foil film F to move in the widthwise direction.

The first side wall C22 supports one end of the supply shaft 32 in a manner that allows the one end to rotate. The second side wall C23 has a hole H3 that allows the other end of the supply shaft 32 to pass therethrough.

The third case member C3 is a cover that covers a gear G1. The third case member C3 is fixed to one axial end of the first case member C1 and one axial end of the second case member C2. Here, the gear G1 is a gear for applying a load on the supply shaft 32 in combination with a gear G2. The gear G2 is fixed at one end of the supply shaft 32 and is connected to the gear G1 via a gear not shown. The gear G1 is connected to a load mechanism provided at the housing main body 21.

The fourth case member C4 has a support portion C41 for supporting the other end of the supply shaft 32 in a manner that allows the other end to rotate. The fourth case member C4 is fixed to the other axial end of the first case member C1 and the other axial end of the second case member C2.

Figure 6A:
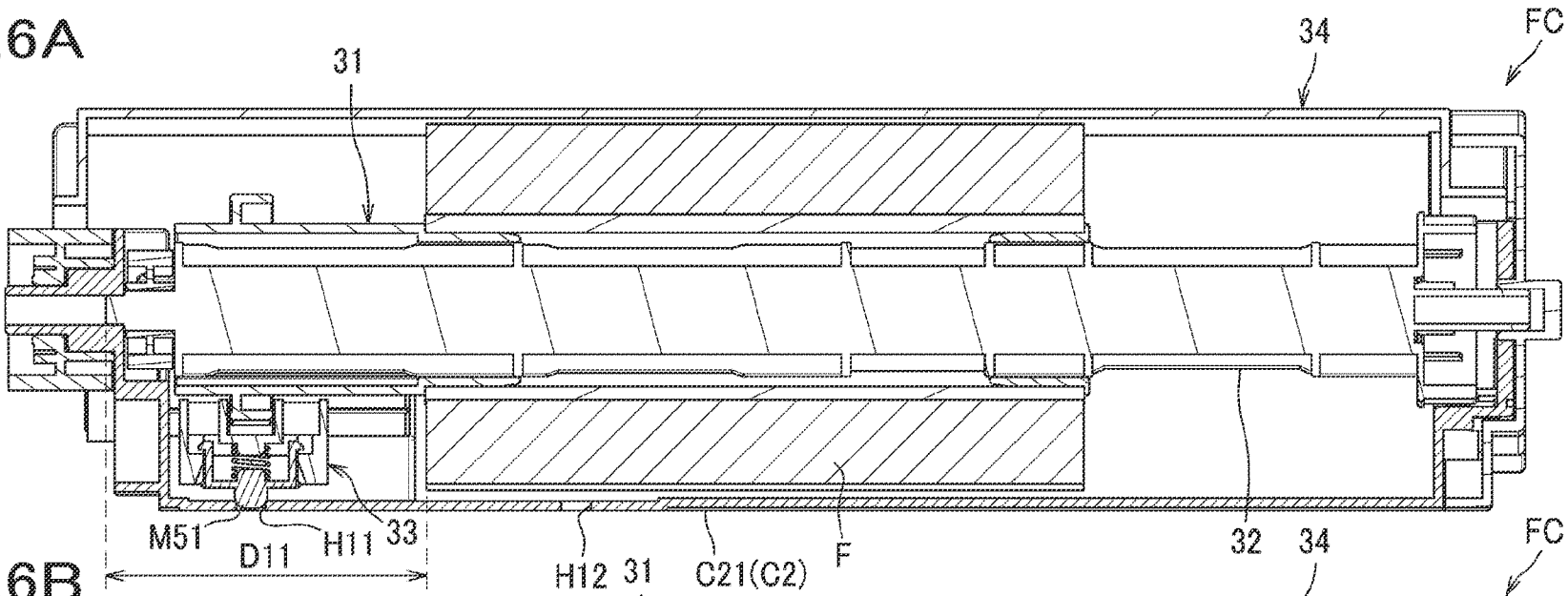
FIG. 6A is a section view showing a state in which the supply reel is located in a first position.

As shown in FIG. 6A, a first hole H11 and a second hole H12 that allow the first projection M51 to be fitted therein are formed in the outer peripheral wall C21 of the second case member C2. The first hole H11 and the second hole H12 form a supply-position locating part, in combination with the first protrusion M51, for locating the supply reel 31 in the first position or the second positon. The first protrusion M51 has an end shaped as a curved surface so that the first protrusion M51 is easily disengaged from each of the holes H11, H12 when the supply reel 31 is moved in the widthwise direction.

The first hole H11 is located in a position to engage with the first protrusion M51 when the supply reel 31 is located in the first position shown in FIG. 6A. In other words, the first hole H11 is located in a position corresponding to the first position.

Figure 6B:
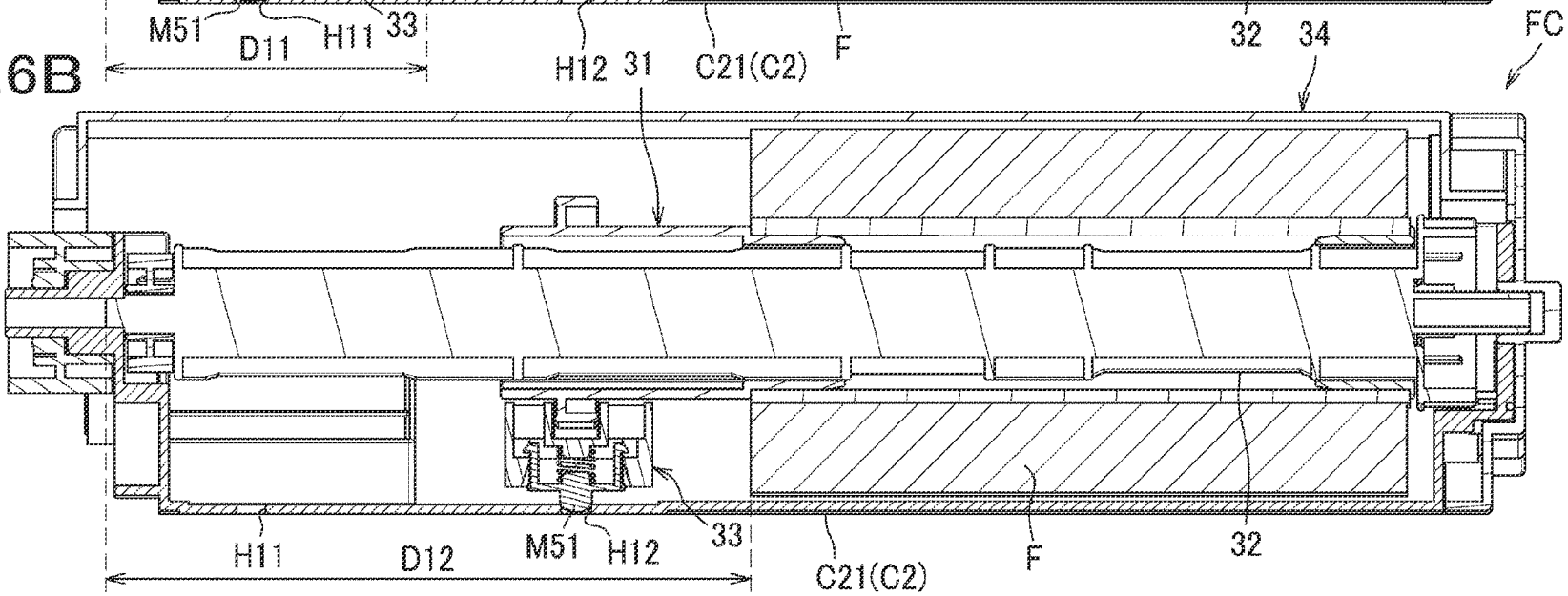
FIG. 6B is a section view showing a state in which the supply reel is located in a second position.

The second hole H12 is located in a position to engage with the first protrusion M51 when the supply reel 31 is located in the second position shown in FIG. 6B. In other words, the second hole H11 is located in a position corresponding to the second position.

In this example, the first position is a position in the center of the supply shaft 32 in the axial direction, and the second position is a position shifted from the center of the supply shaft 32 toward the other end of the supply shaft 32 in the axial direction. Specifically, as shown in FIG. 6A, when the supply reel 31 is located in the first position, the foil film F is located apart from one end of the supply shaft 32 by a first distance D11. Further, as shown in FIG. 6B, when the supply reel 31 is located in the second position, the foil film F is located apart from the one end of the supply shaft 32 by a second distance D12 greater than the first distance D11. The lever 33 is located within the first distance D11 from the one end of the supply shaft 32 when the supply reel 31 is located in the first position.

Figure 7:
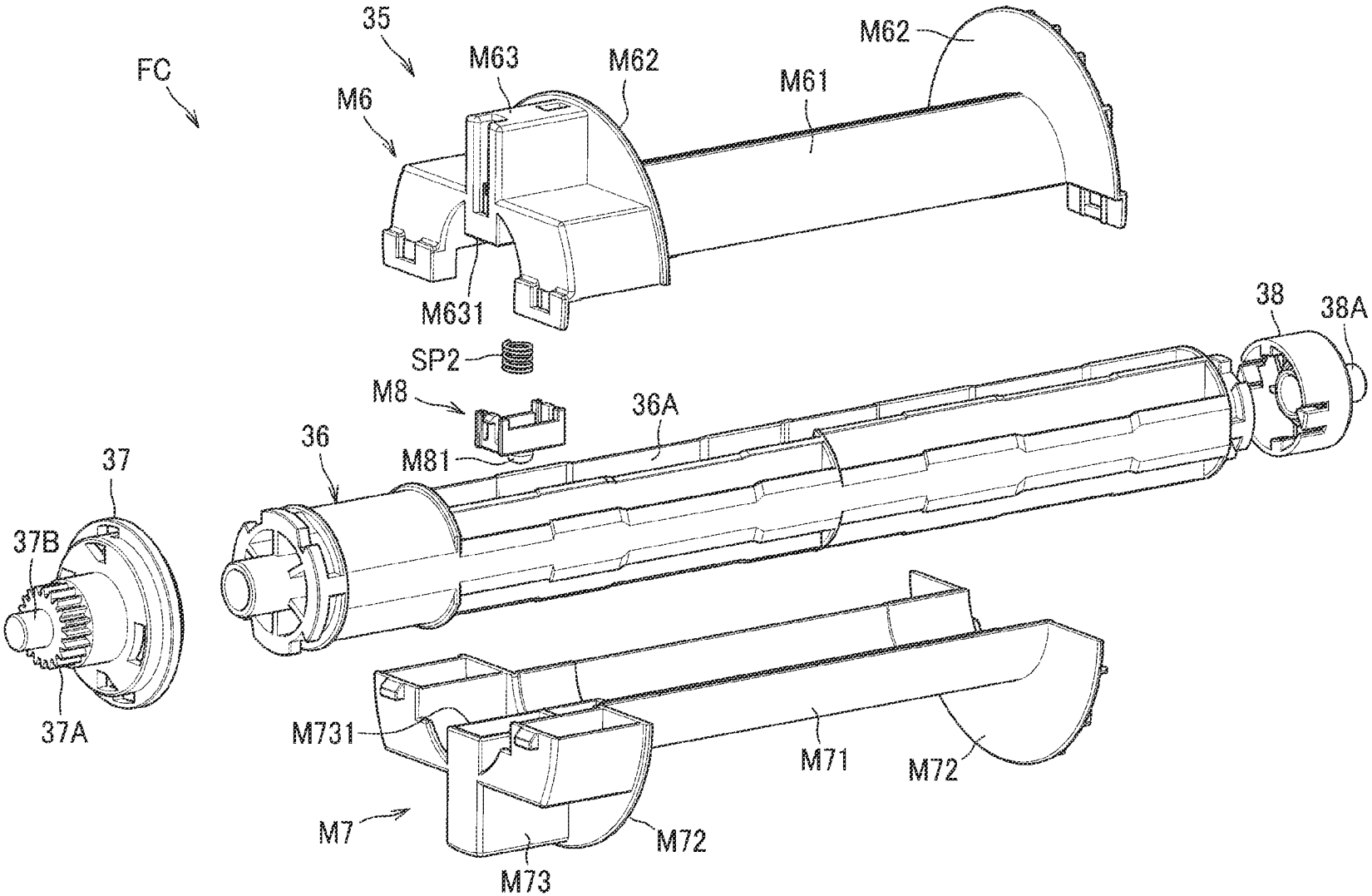
FIG. 7 is an exploded perspective view of a foil transfer film cartridge showing take-up-reel-side structures.

As shown in FIG. 7, the foil transfer film cartridge FC comprises the take-up reel 35 and a take-up shaft 36. The take-up reel 35 and the take-up shaft 36 are made of plastic or the like.

The take-up reel 35 comprises a first reel member M6, a second reel member M7, and a third reel member M8. The first reel member M6 includes a hemicylindrical base portion M61, semicircular flange portions M62, and a bulging portion M63.

The flange portions M62 are provided on one axial end and the other axial end of the base portion M61. The flange portions M62 extend from an outer peripheral surface of the base portion M61. The bulging portion M63 bulges in the axial direction from a surface of one flange portion M62 opposite to a side on which the base portion M61 is located. The bulging portion M63 includes a protrusion M631 that protrudes toward the take-up shaft 36.

The second reel member M7 has approximately the same structure as the first reel member M6. Specifically, the second reel member M7 includes a base portion M71, flange portions M72 located on one axial end and the other axial end of the base portion M71, and a bulging portion including a protrusion M731, each having a structure approximately the same as the corresponding parts of the first reel member M6.

The second reel member M7 is assemblable with the first reel member M6 so that each end of the base portion M71 in the circumferential direction abuts on a corresponding end of the base portion M61 of the first reel member M6. When the first reel member M6 and the second reel member M7 are assembled together, the base portions M61, M71 form a shape of a cylinder in which the take-up shaft 36 is placed.

The third reel member M8 is supported by the bulging portion M631 of the first reel member M6 in a manner that allows the third reel member M8 to move in the radial direction of the take-up reel 35. Specifically, the protrusion M631 has a concave portion that supports the third reel member M8 in a manner that allows the third reel member M8 to move. The third reel member M8 includes a second protrusion M81 formed thereon. The second protrusion M81 forms a take-up locating part for locating the take-up reel 35 in a third position or a fourth position. The second protrusion M81 is movable together with the take-up reel 35 in the widthwise direction. A second spring SP2 that biases the second protrusion M81 toward the take-up shaft 36 is provided between the third reel member M8 and the first reel member M6.

The take-up shaft 36 is a shaft longer in the widthwise direction than the first width B1. Specifically, the take-up shaft 36 is longer in the widthwise direction than the take-up reel 35. The take-up shaft 36 engages with the take-up reel 35 in a circumferential direction of the take-up shaft 36 so as to be rotatable together with the take-up reel 35.

Specifically, the take-up shaft 36 has a groove 36A extending in the axial direction in an outer peripheral surface thereof. The protrusion M631 of the first reel member M6 is configured to be placed in the groove 36A. Since the groove 36A and the protrusion M631 engage with each other in the circumferential direction of the take-up shaft 36 when the protrusion M631 is placed in the groove 36A, the take-up shaft 36 and the take-up reel 35 are capable of rotating together. Further, by the protrusion M631 being placed in the groove 36A, the take-up shaft 36 is configured to support the take-up reel 35 in a manner that allows the take-up reel 35 to move between the third position and the fourth position different from the third position. Although not shown in the drawings, the take-up shaft 36 also has a groove extending in the axial direction in which the protrusion M731 of the second reel member M7 is placed.

On one end of the take-up shaft 36, an input member 37 for inputting a drive force to the take-up shaft 36 is provided. The input member 37 includes a gear 37A to which a drive force is inputted from the drive source provided at the housing main body 21, and a shaft 37B rotatably supported by the holder 100 (see FIG. 2). On the other end of the take-up shaft 36, a cap 38 including a shaft 38A rotatably supported by the holder 100 is provided.

Figure 8A:
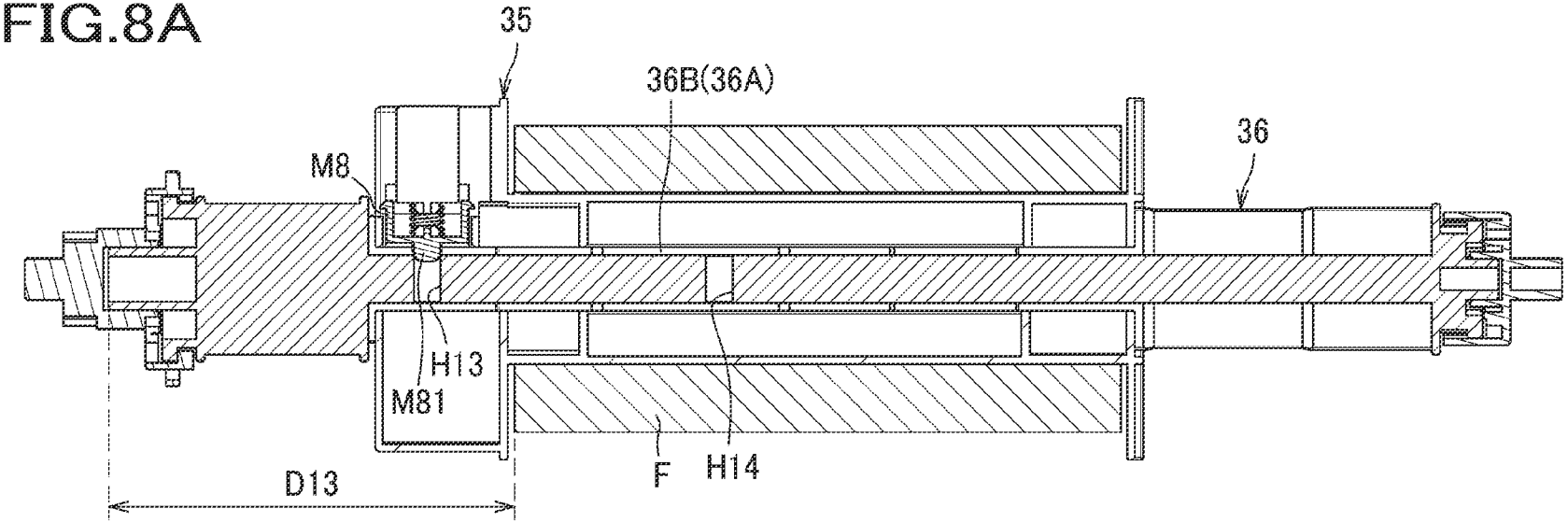
FIG. 8A is a section view showing a state in which the take-up reel is located in a third position.

As shown in FIG. 8A, a third hole H13 and a fourth hole H14 that allow the second protrusion M81 to be fitted therein are formed on a bottom wall 36B of the groove 36A of the take-up shaft 36. The third hole H13 and the fourth hole H14 form, together with the second protrusion M81, a take-up locating part for locating the take-up reel 35 in the third position or the fourth position. Although the third hole H13 and the fourth hole H14 are through holes in this example, the third hole H13 and the fourth hole H14 may be a concave hole. The second protrusion M81 has an end shaped as a curved surface so that the second protrusion M81 is easily disengaged from each of the holes H13, H14 when the take-up reel 35 is moved in the widthwise direction.

The third hole H13 is located in a position to engage with the second protrusion M81 when the take-up reel 35 is positioned in the third position shown in FIG. 8A. In other words, the third hole H13 is located in a position corresponding to the third position.

Figure 8B:
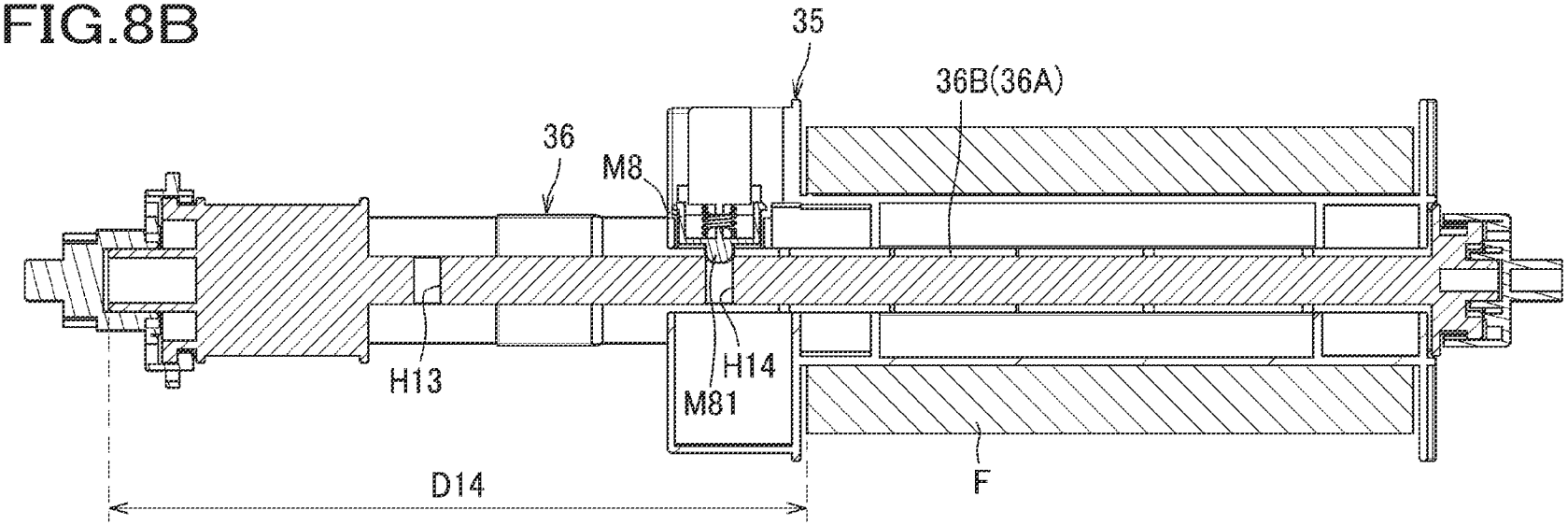
FIG. 8B is a section view showing a state in which the take-up reel is located in a fourth position.

The fourth hole H14 is located in a position to engage with the second protrusion M81 when the take-up reel 35 is located in the fourth position shown in FIG. 8B. In other words, the fourth hole H14 is located in a position corresponding to the fourth position.

In this example, the third position is a position in the center of the take-up shaft 36 in the axial direction, and the fourth position is a position shifted from the center toward the other end of the take-up shaft 36 in the axial direction. Specifically, the first position and the third position are set in such a manner that when the supply reel 31 is located in the first position and the take-up reel 35 is located in the third position, the foil film F is located in the center of the supply shaft 32 and the take-up shaft 36 in the axial direction, and the ends of the foil film F in the widthwise direction extend in the conveyance direction. The second position and the fourth position are set such that when the supply reel 31 is located in the second position and the take-up reel 35 is located in the fourth position, the foil film F is located in a position shifted from the center toward the other ends of the supply shaft 32 and the take-up shaft 36 in the axial direction, and the ends of the foil film F in the widthwise direction extend in the conveyance direction.

As shown in FIG. 8A, when the take-up reel 35 is located in the third position, the foil film F is located apart from one end of the take-up shaft 36 by a third distance D13. Further, as shown in FIG. 8B, when the take-up reel 35 is located in the fourth position, the foil film F is located apart from the one end of the take-up shaft 36 by a fourth distance D14 greater than the third distance D13. The second protrusion M81 is located within the third distance D13 from the one end of the take-up shaft 36 when the take-up reel 35 is located in the third position.

Figure 9A:
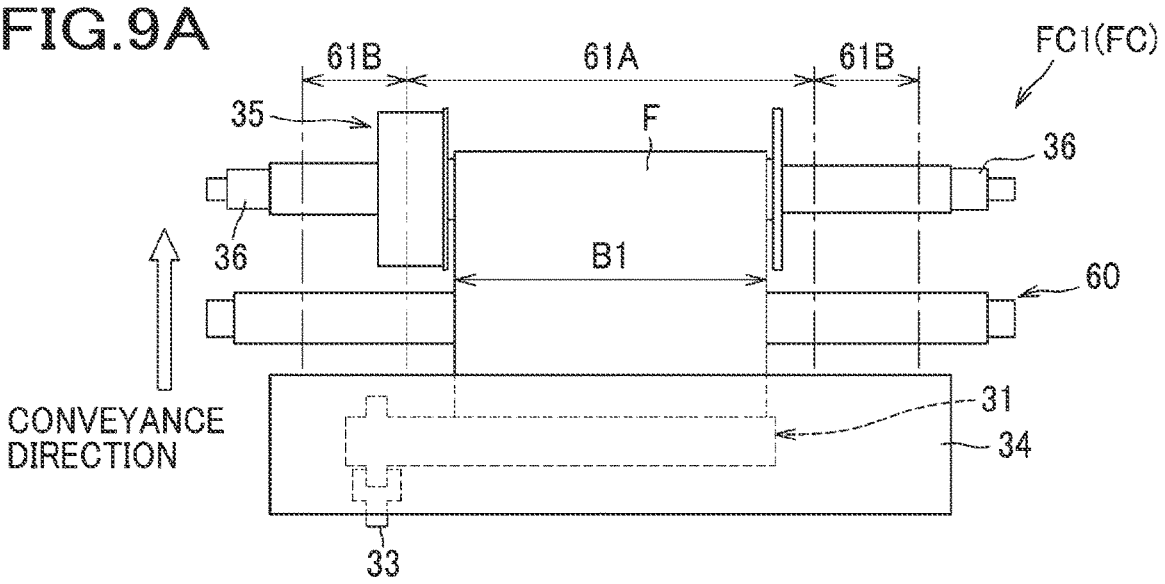
FIG. 9A is an illustration showing an in-center cartridge.

As shown in FIG. 9A, when the supply reel 31 is located in the first position and the take-up reel 35 is located in the third position, the foil film F in the foil transfer film cartridge FC installed in the housing main body 21 is positioned in the center in the widthwise direction to overlap only the first portion 61A of the heating portion 60. In this case, the lever 33 movable together with the supply reel 31 in the widthwise direction is located in a first lever position corresponding to the first position, specifically, a position shifted toward one axial end of the supply case 34.

The lever 33 located in the first lever position is configured to be capable of pressing a first actuator A1 (see FIG. 10A) which will be described below, when the foil transfer film cartridge FC is being installed into the housing main body 21. In the following description, the foil transfer film cartridge FC in which the foil film F is located in the center in the widthwise direction is also referred to as "in-center cartridge FC1".

Figure 9B:
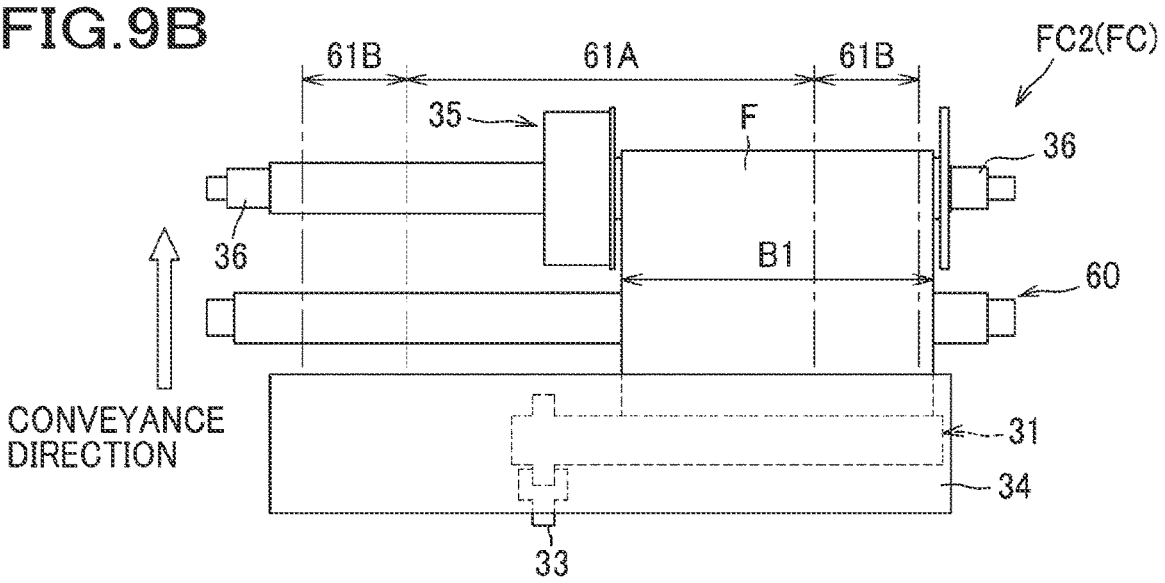
FIG. 9B is an illustration showing an off-center cartridge.

As shown in FIG. 9B, when the supply reel 31 is located in the second position and the take-up reel 35 is located in the fourth position, the foil film F in the foil transfer film cartridge FC installed in the housing main body 21 is positioned to overlap the first portion 61A of the heating portion 60 and the second portion 61B on the other end of the heating portion 60. In this case, the lever 33 movable together with the supply reel 31 in the widthwise direction is located in a second lever position corresponding to the second position, specifically, a position shifted toward the other axial end of the supply case 34 than the first lever position.

The lever 33 located in the second lever position is configured to be capable of pressing a second actuator A2 (see FIG. 10A) which will be described below, when the foil transfer film cartridge FC is being installed into the housing main body 21. In the following description, the foil transfer film cartridge FC in which the foil film F is shifted toward the other end in the widthwise direction is also referred to as "off-center cartridge FC2".

In FIG. 9, the direction of conveyance of a sheet S is shown as a direction from a lower portion to an upper portion of the figure for the sake of convenience. On the other hand, in FIG. 4A, the direction of conveyance of a sheet is shown as a direction from an upper portion to a lower portion of the figure. Therefore, the off-center cartridge FC2 is installed in the housing main body 21 shown in FIG. 4A upside down. With the off-center cartridge FC2 installed in the housing main body 21 such as described above, the foil film F is located in a position corresponding to a sheet SH3 shifted to one side.

Figure 9C:
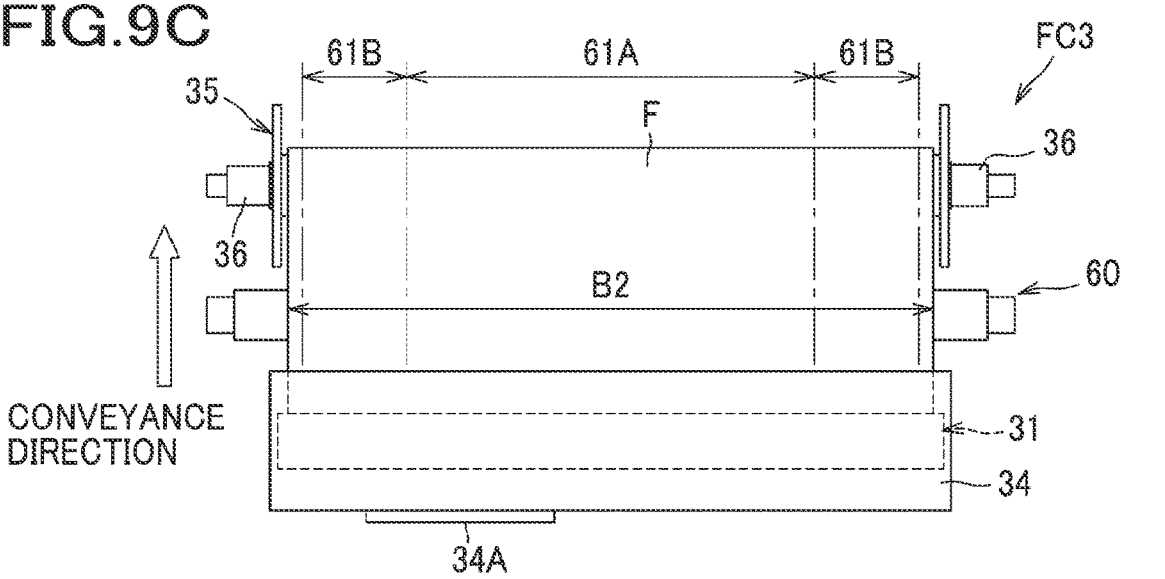
FIG. 9C is an illustration showing a second foil transfer film cartridge.

The housing main body 21 is configured to allow a second foil transfer film cartridge FC3 shown in FIG. 9C to be removably installed therein. Specifically, the second foil transfer film cartridge FC3 is installable into and removable from the holder 100 described above (see FIG. 2).

The second foil transfer film cartridge FC3 includes a foil film F having a widthwise dimension of a second width B2 greater than the first width B1. The second foil transfer film cartridge FC3 has a structure somewhat different from the foil transfer film cartridge FC; however, since the structure thereof is basically approximately the same as that of the foil transfer film cartridge FC, the approximately same members are identified by the same reference characters and explanation thereof is omitted as appropriate.

The second foil transfer film cartridge FC3 is different from the foil transfer film cartridge FC in that the widthwise dimension of the supply reel 31 and the take-up reel 35 is made larger in accordance with the foil film F having a widthwise dimension of the second width B2. Further, the second foil transfer film cartridge FC3 is different from the foil transfer film cartridge FC in that the supply reel 31 and the take-up reel 35 do not move in the widthwise direction.

The supply case 34 of the second foil transfer film cartridge FC3 is formed with a protrusion 34A protruding from an outer peripheral surface thereof. The protrusion 34A is formed in a region extending in the widthwise direction from a position corresponding to the first lever position to a position corresponding to the second lever position. In this way, the protrusion 34A is capable of pressing both of the first actuator A1 and a second actuator A2 which will be described below (see FIG. 10A) when the second foil transfer film cartridge FC3 is being installed into the housing main body 21.

As shown in FIGS. 10A to 10C, the housing main body 21 comprises a sensor SE capable of detecting the lever 33 and the protrusion 34A. The sensor SE includes the first actuator A1, a first sensor SE1, the second actuator A2, and a second sensor SE2.

The first actuator A1 is a member that is contacted by the lever 33 and rotates when the foil transfer film cartridge FC with the supply reel 31 located in the first position, i.e., the in-center cartridge FC1 is installed into the housing main body 21. That is, the first actuator A1 is located in a position corresponding to the lever 33 located in the first lever position.

The second actuator A2 is a member that is contacted by the lever 33 and rotates when the foil transfer film cartridge FC with the supply reel 31 located in the second position, i.e., the off-center cartridge FC2 is installed into the housing main body 21. That is, the second actuator A2 is located in a position corresponding to the lever 33 located in the second lever position.

The first actuator A1 and the second actuator A2 are each rotatable between a non-detection position shown in FIG. 10B and a detection position shown in FIG. 10C. When the foil transfer film cartridge FC is installed into the housing main body 21, one of the first actuator A1 and the second actuator A2 is maintained in the non-detection position, and the other of the first actuator A1 and the second actuator A2 is rotated to the detection position. When the second foil transfer film cartridge FC3 is installed into the housing main body 21, both of the first actuator A1 and the second actuator A2 are contacted by the protrusion 34A (see FIG. 9C) of the second foil transfer film cartridge FC3 and rotate to the detection position.

The first sensor SE1 is a sensor for detecting the position of the first actuator A1. The second sensor SE2 is a sensor for detecting the position of the second actuator A2. The first sensor SE1 and the second sensor SE2 are, for example, optical sensors including a light-emitting portion and a light-receiving portion.

In this example, when the actuator (A1, A2) is located in the non-detection position, light emitted from the light-emitting portion is blocked by the actuator; thus, the optical sensor (SE1, SE2) is in an off state and does not output any signal. When the actuator (A1, A2) is located in the detection position, light emitted from the light-emitting portion is received by the light-receiving portion; thus, the optical sensor (SE1, SE2) is in an on state and outputs a signal.

The controller 80 is capable of determining a widthwise position and a widthwise dimension of the supply reel 31 based on information from the sensor SE. Specifically, the controller 80 determines the type or other categories of the foil transfer film cartridge FC from a combination of signals output from the first sensor SE1 and the second sensor SE2.

Specifically, the controller 80 determines, if the first sensor SE1 and the second sensor SE2 are both off, as shown in FIG. 11, neither the foil transfer film cartridge FC nor the second foil transfer film cartridge FC3 is installed in the housing main body 21. The controller 80 determines, if the first sensor SE1 is on and the second sensor SE2 is off, the in-center cartridge FC1 is installed in the housing main body 21, i.e., the supply reel 31 is located in the first position and the width of the foil film F is the first width B1.

The controller 80 determines, if the first sensor SE1 is off and the second sensor SE2 is on, the off-center cartridge FC2 is installed in the housing main body 21, i.e., the supply reel 31 is located in the second position and the width of the foil film F is the first width B1. The controller 80 determines, if both of the first sensor SE1 and the second sensor SE2 are on, the second foil transfer film cartridge FC3 is installed in the housing main body 21, i.e., the width of the foil film F is the second width B2.

The controller 80 has a function of controlling, during the foil transfer process, the first heater 62 at a predetermined power consumption, and the second heater 63 at a first power consumption or a second power consumption smaller than the first power consumption. The controller 80 has a function of controlling, when it determines the supply reel 31 is positioned in the first position, the second heater 63 at the second power consumption. The controller 80 has a function of controlling, when it determines the supply reel 31 is positioned in the second position, the second heater 63 at the first power consumption.

Next, one example of a process executed by the controller 80 of this example will be described referring to the flowchart of FIG. 12. The process shown in FIG. 12 is started when power to the foil transfer device 1 is turned on, and at least one of the first sensor SE1 and the second sensor SE2 is on.

As shown in FIG. 12, the controller 80 firstly determines whether or not a command to transfer foil has been received (S1). If it is determined that a command to transfer foil has not been received in step S1 (S1, No), the controller 80 waits until a command to transfer foil is received.

If it is determined that a command to transfer foil has been received in step S1 (S1, Yes), the controller 80 determines whether the foil transfer film cartridge installed in the housing main body 21 is the off-center cartridge FC2 or the second foil transfer film cartridge FC3 (S2).

If it is determined, in step S2, that the installed foil transfer film cartridge is not the off-center cartridge FC2 or the second foil transfer film cartridge FC3, in other words the foil transfer film cartridge is the in-center cartridge FC1 (S2, No), the controller 80 switches the first heater 62 on and the second heater off (S21). That is, if the supply reel 31 is located in the first position, the controller 80 controls the second heater 63 at the second power consumption, specifically, at zero.

On the other hand, if it is determined in step S2 that the foil transfer film cartridge is the off-center cartridge FC2 or the second foil transfer film cartridge FC3 (S2, Yes), the controller 80 switches the first heater 62 and the second heater 63 on (S11). That is, if the supply reel 31 is located in the second position, the controller 80 controls the second heater 63 at the first power consumption larger than zero.

When the temperature of the heating member 61 reaches a predetermined temperature after step S11 or after step S21, conveyance of a sheet S is started (S12). After step S12, the controller 80 determines whether foil transfer has finished (S13). Whether foil transfer has finished may be determined, for example, by the time elapsed after the center sheet sensor 91 switches off.

If it is determined in step S13 that foil transfer is not finished yet (S13, No), the controller 80 waits until foil transfer is finished, and if it is determined that foil transfer is finished (S13, Yes), the controller 80 determines whether there is a next sheet on which foil is to be transferred (S14).

In step S14, if it is determined that there is a next sheet on which foil is to be transferred (S14, Yes), the controller 80 proceeds to step S2, and if it is determined that there is no next sheet on which foil is to be transferred (S14, No), the controller 80 switches off one or each of the first heater 62 and the second heater 63 that is on and ends the present process.

According to the above, the following advantageous effects can be achieved by this example.

Since the widthwise position of the foil film F can be changed in one foil transfer film cartridge FC, the user does not have to possess many cartridges and the convenience of the user can thereby be improved.

Since the lever 33 for moving the supply reel 31 is provided accessibly in the supply case 34, the user can easily change the widthwise position of the foil film F by operating the lever 33 provided accessibly in the supply case 34.

Since the lever 33 is located within the first distance D11 from the one end of the supply shaft 32 when the supply reel 31 is located in the first position, potential dead space within the first distance D11 from the one end of the supply shaft 32 can be utilized advantageously.

Since the second protrusion M81 is positioned within the third distance D13 from the one end of the take-up shaft 36 when the take-up reel 35 is located in the third position, potential dead space within the third distance D13 from the one end of the take-up shaft 36 can be used advantageously.

Since the supply-position locating part for locating the supply reel 31 in the first position or the second position is provided, the foil film F located in the first position or the second position can be restrained from moving widthwise during foil transfer.

Since the take-up-position locating part for locating the take-up reel 35 in the third position or the fourth position is provided, the foil film F located in the third position or the fourth position can be restrained from moving widthwise during foil transfer.

Since the sensor SE that is capable of detecting the lever 33 is provided, the controller 80 can grasp the widthwise position of the foil film F.

Since the second heater 63 is controlled at the second power consumption when the supply reel 31 is located in the first position, and the second heater 63 is controlled at the first power consumption greater than the second power consumption when the supply reel 31 is located in the second position, the heaters can be controlled appropriately according to the position of the foil film F.

Since the first actuator A1 and the second actuator A2 can be rotated by contact with the lever 33 positioned in the first lever position or the second lever position, and also can be rotated by contact with the second foil transfer film cartridge FC3, the position and width of the foil film F can be determined by the two actuators A1, A2.

Although one example of a foil transfer device has been described above, the specific configurations may be modified as appropriate without departing from the spirit of this example.

Although the foil transfer film cartridge FC comprises the take-up reel 35 in the above-described example, the foil transfer film cartridge may not comprise a take-up reel. In this case, a take-up reel may be provided, movably in the widthwise direction, on the housing main body.

Although the lever engaged with the supply reel is provided in the above-described example, a lever may not be provided. In this case, for example, an opening for directly operating the supply reel therethrough may be provided.

The supply-position locating part and the take-up position locating part are not limited to the configurations of the above-described example, and the projections and depressions of the above-described example may, for example, be interchanged.

Although the sensor is comprised of an actuator and an optical sensor in the above-described example, the sensor may be comprised, for example, of only an optical sensor. Further, the actuator may, for example, be an actuator which is linearly movable.

Although the lever 33 is engaged with the supply reel 31 in the above-described example, the lever may be formed, for example, integrally with the supply reel.

Although the pressure roller 51 is given as an example of a pressure member in the above-described example, the pressure member may be a member comprising a belt and a pad.

Although the heating member 61 is a roller made of a metal tube formed in a shape of a cylinder in the above-described example, the heating member may, for example, be a belt or a film such as a cylinder-shaped film slidably supported by a guide. The heating member may also be a thermal head. Further, a heater for heating the heating member may be located outside the heating member.

Although the second heater 63 has a power output higher at both end portions 63B than at the center portion 63A, and thus heats the second portions 61B that are end portions of the heating member 61 at an intensity higher than an intensity at which the second heater 63 heats the first portion 61A in the above-described example, only one end portion 63B of the end portions 63B may have a power output higher than that of the center portion 63A, and only one of the second portions 61B of the heating member 61 may be heated at an intensity higher than an intensity at which the first portion 61A is heated. In this case, a third heater with only one end portion of end portions in the widthwise direction having a power output higher than that of a center portion, and that heats only the other of the second portions 61B of the heating member 61 at an intensity higher than an intensity at which the first portion 61A is heated may be provided.

If the second heater 63 is a heater in which only one end portion of the end portions 63B have a power output higher than that of the center portion 63A, and only one of the second portions 61B of the heating member 61 is heated at an intensity higher than an intensity at which the first portion 61A is heated, the first heater 62 may be configured such that a power output of the center portion 62A and the other end portion of the end portions 62B is higher than a power output of one end portion, and the first portion 61A and the other of the second portions 61B is heated at an intensity higher than an intensity at which the one of the second portions 61B is heated.

Although the film unit FU with the foil transfer film cartridge FC installed in the holder 100 is installed into the housing main body 21, the foil transfer film cartridge FC may be configured to be directly installed into the housing main body 21 without being installed in the holder. In this case, a part corresponding to the holder of the above-described example may be formed integrally with the housing main body.

Although the foil transfer device 1 of the above-described example is configured such that the heating portion 60 is movable by the contact/separation mechanism 70, the pressure member instead may be configured to be movable by the contact/separation mechanism, or both of the heating member and the pressure member may be configured to be movable by the contact/separation mechanism.

A detailed description will be given of a second example of a foil transfer device with reference made to the drawings where appropriate. Although this example has a structure somewhat different from that of the above example, the structure thereof is basically approximately the same; therefore, the approximately same members are identified by the same reference characters and explanation thereof is omitted as appropriate.

As shown in FIG. 13A, a cover open-close sensor 23 for detecting the opening and closing of the cover 22, and a display 24 are provided on the housing 2. The cover open-close sensor 23 exhibits an ON signal if the cover 22 is closed (see FIG. 13A), and exhibits an OFF signal if the cover 22 is open (see FIG. 14). When the cover 22 is closed from an open state, a signal of the cover open-close sensor 23 changes from an OFF signal to an ON signal. The display 24 shows various kinds of messages based on commands from a controller 300 which will be described below. In this example, the display 24 also serves as an operation screen that shows a selection screen and sends selection results to the controller 300 if a user selects execution of foil transfer.

The sheet conveyor unit 10 is driven to rotate by a motor (not shown) to convey a sheet S.

The sheet feed mechanism 11 comprises the supply roller 11A, the retard roller 11B, and an upstream conveyor roller 11C as one example of a conveyor roller.

The supply roller 11A is a roller that picks up a sheet S placed on the sheet tray 3. The retard roller 11B is a roller that separates the sheets S conveyed by the supply roller 11A one from others. The supply roller 11A is operated only for a predetermined time when picking up a sheet S. The predetermined time is, for example, a period of time it takes for the supply roller 11A to make one rotation.

The retard roller 11B is located above the supply roller 11A. The retard roller 11B is rotatable in such a direction as to move sheets S overlaid on a sheet S conveyed forward by the supply roller 11A, backward toward the sheet tray 3.

The upstream conveyor roller 11C is comprised of two rollers, and can convey a sheet S by rotating, with the sheet S sandwiched between the two rollers. The upstream conveyor roller 11C is located between the supply roller 11A and the transfer unit 50, and conveys the sheet S picked up by the supply roller 11A to the transfer unit 50.

The sheet ejection mechanism 12 comprises a downstream conveyor roller 12A and an ejection roller 12B. The downstream conveyor roller 12A and the ejection roller 12B are each comprised of a pair of rollers and are capable of conveying a sheet S when rollers rotate, with the sheet S sandwiched between the rollers. The downstream conveyor roller 12A is located between the transfer unit 50 and the ejection roller 12B, and conveys a sheet S conveyed forward by the transfer unit 50 to the ejection roller 12B. The ejection roller 12B is located downstream of the downstream conveyor roller 12A in a direction of conveyance of a sheet S, and ejects the sheet S conveyed forward by the downstream conveyor roller 12A to the outside of the housing 2.

As shown in FIG. 13B, the foil film F is a film comprised of a plurality of layers. Specifically, the foil film F includes a supporting layer F1 and a supported layer F2. The supporting layer F1 is a transparent substrate in the form of a tape made of polymeric material and supports the supported layer F2. The supported layer F2 includes, for example, a release layer F21, a transfer layer F22, and an adhesive layer F23. The release layer F21 is a layer for facilitating separation of the transfer layer F22 from the supporting layer F1, and is interposed between the supporting layer F1 and the transfer layer F22. The release layer F21 contains a transparent material, such as a wax-type resin, easily releasable from the supporting layer F1.

The transfer layer F22 is a layer to be transferred onto a toner image, and contains foil. Foil is a thin sheet of metal such as gold, silver, copper, aluminum, etc. The transfer layer F22 contains a colorant of gold-colored, silver-colored, red-colored, or other colorant, and a thermoplastic resin. The transfer layer F22 is interposed between the release layer F21 and the adhesive layer F23.

The adhesive layer F23 is a layer for facilitating adhesion of the transfer layer F22 to a toner image. The adhesive layer F23 contains a material, for example, such as vinyl chloride resin or acrylic resin, which tends to adhere to a toner image heated by the transfer unit 50 which will be described below.

The supply reel 31 is made of plastic or the like, and includes the supply shaft 31A on which the foil film F is wound. One end of the foil film F is fixed to the supply shaft 31A.

The take-up reel 35 is made of plastic or the like, and includes the take-up shaft 35A on which to take up the foil film F. The other end of the foil film F is fixed to the take-up shaft 35A.

The transfer unit 50 includes the pressure roller 51, the heating portion 60, and the contact/separation mechanism 70. A sheet S and foil film F are conveyed as the pressure roller 51 and the heating portion 60 rotate with the sheet S and foil film F sandwiched therebetween.

The heating portion 60 includes the heating member 61 and a heater H. The heating member 61 is a roller formed of a cylindrical metal tube in which the heater H is located, and is heated by the heater H; the heating member 61 heats the foil film F and a sheet S.

The contact/separation mechanism 70 is a mechanism for switching the state of the pressure roller 51 and the heating member 61 to a pressing state in which the foil film F is sandwiched between the pressure roller 51 and the heating member 61, and to a separate state in which at least one of the pressure roller 51 and the heating member 61 is separated from the foil film F. In this example, the contact/separation mechanism 70 causes the heating member 61 to contact or to be separated from the foil film F by moving the heating member 61 between a pressing position shown in FIG. 13 by a solid line, and a separate position shown in FIG. 13 by a chain double-dashed line. That is, the contact/separation mechanism 70 causes the pressure roller 51 and the heating member 61 to assume the separate state by separating the heating member 61 from the foil film F. Further, the contact/separation mechanism 70 causes the pressure roller 51 and the heating member 61 to assume the pressing state by pressing the heating member 61 against the foil film F.

The controller 300 comprises a CPU, a RAM, a ROM, an input/output circuit, etc. The controller 300 is configured to execute control by performing various arithmetic processing based on programs and data stored in the RAM, the ROM, and other storage devices. The controller 300 may be a device similar to the controller 80.

In the following description, transfer of the transfer layer F22 onto a toner image is also referred to simply as "foil transfer".

As shown in FIG. 15, a third foil transfer film cartridge FC4 comprises a foil film F, a supply reel 31, a take-up reel 35, and a supply case 34. The third foil transfer film cartridge FC4 is removably installable into the housing 2 through the opening 21A when the cover 22 is open. It is to be understood that components provided on a holder 100 may be provided on the housing main body 21 and the third foil transfer film cartridge FC4 may be configured to be directly installable into and removable from the housing main body 21.

The supply reel 31 (specifically, the supply case 34) and the take-up reel 35 are removably installable into the holder 100 in a direction perpendicular to the axial direction of the supply reel 31.

The supply case 34 is a hollow case which houses the supply reel 31. The supply case 34 comprises an approximately cylindrical outer peripheral wall 34P, and two approximately disc-shaped side walls 34S located on both sides of the outer peripheral wall 34P. The supply reel 31 is rotatably supported by each of the side walls 34S of the supply case 34.

On the outer peripheral wall 34P, three concave portions 34D are formed side by side in the axial direction of the supply reel 31, and engagement pieces P1, P2, P3 which serve as identifiers can be fixed in each of the concave portions 32D.

The holder 100 comprises a base frame 110 and a restraining frame 120 rotatably (movably) supported by the base frame 110.

The base frame 110 supports the first guide shaft 41 and the second guide shaft 42 which are described above, in a manner that allows the first guide shaft 41 and the second guide shaft 42 to rotate. The base frame 110 includes a first holding portion 111, a second holding portion 112, and two handles 114.

The restraining frame 120 supports the third guide shaft 43 in a manner that allows the third guide shaft 43 to rotate.

The first holding portion 111 is a portion that holds the supply case 32. The first holding portion 111 holds the supply reel 31 via the supply case 32.

The second holding portion 112 is a portion that holds the take-up reel 35. To be more specific, the second holding portion 112 forms a hollow case with the restraining frame 120, and the take-up reel 35 is contained in the hollow case.

The take-up reel 35 comprises the take-up shaft 35A described above, two flanges 35B, and a take-up gear 35C. The flanges 35B are parts for restricting the widthwise movement of the foil film F wound on the take-up shaft 35A. Each flange 35B is formed in a shape of a disk with a diameter larger than that of the take-up shaft 35A, and is located on a corresponding end of the take-up shaft 35A.

The take-up gear 35C is a gear that receives a driving force from the motor (not shown), and transmits the driving force to the take-up shaft 35A. The take-up gear 35C is provided at an outer side of the flange 35B in the axial direction. The take-up gear 35C is positioned co-axially with the take-up shaft 35A.

Two connecting portions 113 are portions that connect the first holding portion 111 and the second holding portion 112. The connecting portions 113 are arranged apart from each other in the axial direction of the supply reel 31.

With the connecting portions 113 being formed this way, the holder 100 is provided with a through hole 100A extending in an perpendicular direction perpendicular to the axial direction of the supply reel 31.

Each handle 114 is provided on a corresponding connecting portion 113. The handles 114 are located on the holder 100 at the axial ends of the take-up reel 35.

Here, as shown in FIGS. 16A to 16C, the foil transfer device 1 can be configured to allow foil films F of different widths to be installed therein. In this example, the holder 100 can be configured to allow the third foil transfer film cartridge FC4 including a foil film F of various widths and positions to be installed therein.

Specifically, the foil transfer device 1 allows a foil film F having a widthwise dimension of a second width W2, and a foil film F having a widthwise dimension of a first width W1 smaller than the second width W2 to be installed therein. The foil transfer device 1 allows the foil film F of the first width W1 in a center region R2 and in an off-center region R3 (see FIG. 19) to be installed therein. The center region R2 is a region in the widthwise center of a region R1 in which the foil film F of the second width W2 is to be installed. The off-center region R3 is a region shifted widthwise to one side (left side in FIG. 19) of the region R1 in which the foil film F of the second width W2 is to be installed.

More specifically, a first film cartridge FC5 shown in FIG. 16A, a second film cartridge FC6 shown in FIG. 16B or a third film cartridge FC7 is installable in the holder 100.

A film unit FU in which the first film cartridge FC5 with the foil film F of the width W2 is installed, as shown in FIG. 16A, is referred to as a first film unit FU1. The second width W2 is a maximum width of a foil film F that can be placed in the film unit FU, and is 220 mm in one example. The first film unit FU1 is suitable for all sizes of sheets S conveyable, and is particularly suitable when it is desired to transfer foil on the whole widthwise area of a wide sheet.

In the first film unit FU1, the engagement pieces P1, P2, P3 are respectively fixed to all three concave portions 34D formed on the outer peripheral wall 34P.

A film unit in which the second film cartridge FC6 with a foil film F of the width W1 located in the center is installed, as shown in FIG. 16B, is referred to as a second film unit FU2. The first width W1 is smaller than the second width W2, and is 110 mm in one example. The second film unit FU2 is suitable for sheets S of smaller widths or when it is desired to transfer foil on only the center region R2 of a wide sheet, and can save foil film F (see FIG. 19).

In the second film unit FU2, the engagement pieces P1, P3 are fixed to the two concave portions 34D on the left and right sides among the three concave portions 34D formed on the outer peripheral wall 32P, but no engagement piece is fixed to the concave portion 34D in the middle.

A film unit FU in which the third film cartridge FC7 with a foil film F of the width W1 shifted to one side in the widthwise direction of the foil film F is installed, as shown in FIG. 16C, is referred to as a third film unit FU3. The third film unit FU3 is suitable when it is desired to transfer foil on only the off-center region R3 of a wide sheet, and can save foil film F (see FIG. 19).

In the third film unit FU3, the engagement pieces P2, P3 are fixed to the middle concave portion 34D and one of the left and right concave portions 34D among the three concave portions 34D formed on the outer peripheral wall 34P, whereas no engagement piece is fixed to the other of the left and right concave portions 34D.

As shown in FIG. 17A, the foil transfer device 1 comprises a foil-film sensor for detecting a width of the foil film F. The foil-film sensor includes three sensors, i.e., a first sensor AS1, a second sensor AS2, and a third sensor AS3.

The first sensor AS1, the second sensor AS2, and the third sensor AS3 are respectively located in positions corresponding to the three concave portions 34D formed in the outer peripheral wall 34P of the supply case 34 when the film unit FU is installed in the housing main body 21.

The first sensor AS1 transmits a signal indicating low to the controller 300 while it is detecting the engagement piece P1 of the film unit FU, and transmits a signal indicating high to the controller 300 while it is not detecting the engagement piece P1.

The second sensor AS2 transmits a signal indicating low to the controller 300 while it is detecting the engagement piece P2 of the film unit FU, and transmits a signal indicating high to the controller 300 while it is not detecting the engagement piece P2.

The third sensor AS3 transmits a signal indicating low to the controller 300 while it is detecting the engagement piece P3 of the film unit FU, and transmits a signal indicating high to the controller 300 while it is not detecting the engagement piece P3.

The controller 300 receives signals from the first sensor AS1, the second sensor AS2, and the third sensor AS3, and thus is capable of determining which one of the first film unit FU1, the second film unit FU2, and the third film unit FU3 is installed in the housing main body 21.

To be more specific, as shown in the table of FIG. 17B, the controller 300 determines, if the signals from the first sensor AS1, the second sensor AS2, and the third sensor AS3 are all low, that the first film unit FU1 is installed in the housing main body 21.

The controller 300 determines, if the signals from the first sensor AS1 and the third sensor AS3 are low, and the signal from the second sensor AS2 is high, that the second film unit FU2 is installed in the housing main body 21.

The controller 300 determines, if the signals from the second sensor AS2 and the third sensor AS3 are low, and the signal from the first sensor AS1 is high, that the third film unit FU3 is installed in the housing main body 21.

Further, the controller 300 determines, if the signals from the first sensor AS1, the second sensor AS2, and the third sensor AS3 are all high, that none of the first film unit FU1, the second film unit FU2, or the third film unit FU3 is installed in the housing main body 21.

Next, with reference to FIG. 18, a description will be given of sheet sensors provided in a conveyance path of a sheet S (shown by a chain double-dashed line in FIG. 18). In FIG. 18, a simplified view of a configuration of the foil transfer device 1 is shown for the sake of convenience.

As shown in FIG. 18, the foil transfer device 1 comprises a first sheet sensor SS1, a second sheet sensor SS2, a sheet tray sensor SS3, and a sheet-width sensor SS4.

The first sheet sensor SS1 is located between the supply roller 11A and the transfer unit 50 in a direction of conveyance of a sheet S (referred to simply as "conveyance direction" in the following description). More specifically, the first sheet sensor SS1 is located between the supply roller 11A and the upstream conveyor roller 11C in the conveyance direction. The first sheet sensor SS1 is located at a center C of a sheet S (see FIG. 19) in the widthwise direction (the left-right direction of FIG. 19). The first sheet sensor SS1 is capable of detecting the passing by of a sheet S being conveyed toward the transfer unit 50. An ON signal is transmitted to the controller 300 while the first sheet sensor SS1 is detecting the sheet S.

The second sheet sensor SS2 is located in the conveyance direction between the supply roller 11A and the ejection roller 12B, more specifically, between the downstream conveyor roller 12A and the ejection roller 12B. The second sheet sensor SS2 is located at the center C of a sheet S (see FIG. 19) in the widthwise direction (the left-right direction of FIG. 19). The second sheet sensor SS2 is capable of detecting the passing by of a sheet S being conveyed forward from the transfer unit 50. An ON signal is transmitted to the controller 300 while the second sheet sensor SS2 is detecting the sheet S.

The sheet tray sensor SS3 is located at the sheet tray 3 (see FIG. 13, FIG. 19). The sheet tray sensor SS3 is located at the center C of a sheet S (see FIG. 19) in the widthwise direction (the left-right direction of FIG. 19). The sheet tray sensor SS3 is capable of detecting whether or not a sheet S is placed on the sheet tray 3. An ON signal is transmitted to the controller 300 while the sheet tray sensor SS3 is detecting that the sheet S is placed on the sheet tray 3.

The sheet-width sensor SS4 is located between the supply roller 11A and the transfer unit 50 in the conveyance direction. As shown in FIG. 19, the sheet-width sensor SS4 is capable of detecting a sheet S being conveyed toward the transfer unit 50 and passing through the off-center region. In this example, the sheet-width sensor SS4 is located in the off-center region R3 at a position shifted a little upstream from that of the first sheet sensor SS1 in the conveyance direction. The sheet-width sensor SS4 is located in a position shifted to one side from the center C of a sheet S in the widthwise direction (the left-right direction of FIG. 19). An ON signal is transmitted to the controller 300 while the sheet-width sensor SS4 is detecting the sheet S.

In this example, the sheet-width sensor SS4 is located apart from the center C by a distance 75 to 77 mm to the left of FIG. 19.

The sheet-width sensor SS4 is capable of detecting a sheet S1 when the sheet S1 having a width greater than A5 size (width of 148.5 mm) is conveyed through the center.

The sheet-width sensor SS4 is not capable of detecting a sheet S2 when the sheet S2 having a width equal to or smaller than A5 size (width of 148.5 mm) is conveyed through the center.

As described above, if the controller 300 determines via the foil-film sensor (first sensor AS1, second sensor AS2, and third sensor AS3) that the first film unit FU1 is installed in the housing main unit 21, it is recognized that the foil film F of the second width W2 is installed in the region R1 (see FIG. 19).

If the controller 300 determines via the foil-film sensor (first sensor AS1, second sensor AS2, and third sensor AS3) that the second film unit FU2 is installed in the housing main unit 21, it is recognized that the foil film F of the first width W1 is installed in the center region R2 (see FIG. 19).

If the controller 300 determines via the foil-film sensor (first sensor AS1, second sensor AS2, and third sensor AS3) that the third film unit FU3 is installed in the housing main unit 21, it is recognized that the foil film F of the first width W1 is installed in the off-center region R3 (see FIG. 19).

In this way, the foil-film sensor (first sensor AS1, second sensor AS2, and third sensor AS3) allow a determination to be made regarding whether the foil film F of the second width W2 is installed in the region R1, or whether the foil film F of the first width W1 is installed in the off-center region R3 or the center region R2.

Next, the control process executed by the controller 300 will be described.

The controller 300 executes a foil transfer process when a command to start transfer is received.

When the controller 300 receives an ON signal from the sheet tray sensor SS3, the controller 300 determines that a sheet S is placed on the sheet tray 3.

When the controller 300 receives a command to transfer foil in a state where it is determined that a sheet S is placed on the sheet tray 3, the controller 300 executes the foil transfer process. In other words, the controller 300 executes a process to cause the foil transfer device 1 to perform the foil transfer process. First, the upstream conveyor roller 11C, the pressure roller 51, the take-up reel 35, and the sheet ejection mechanism 12 are operated. Then, the controller 300 causes the supply roller 11A to operate for a predetermined time period to pick up a sheet S placed on the sheet tray 3. The sheet S picked up by the supply roller 11A is conveyed by the supply roller 11A toward the transfer unit 50. In the transfer unit 50, foil is transferred on the sheet S conveyed to the transfer unit 50. The controller 300 continues to cause the supply roller 11A to operate for a predetermined time period to pick up a sheet S one by one, and to cause the upstream conveyor roller 11C, the pressure roller 51, the take-up roller 35, and the sheet ejection mechanism 12 to operate until the sheets S on the sheet tray are used up. When the sheets S on the sheet tray 3 are used up, the controller 300, stops the operation of the upstream conveyor roller 11C, the pressure roller 51, the take-up roller 35, and the sheet ejection mechanism 12, after the last sheet S passes through the ejection mechanism 12.

Here, the controller 300 is configured such that upon receipt of a command to transfer foil, operation of the upstream conveyor roller 11C is stopped and an error representation is shown on the display 24, as an error process, on conditions that the foil-film sensor is detecting the foil film of the first width is installed in the off-center region, and that the sheet-width sensor SS4 is not detecting a sheet S.

Specifically, the controller 300 is configured to determine an error when the installed third film cartridge FC7 is detected, and a signal from the sheet-width sensor SS4 remains off.

The error representation may, for example, read "Pull out the jammed sheet. The sheet used does not match the purpose of the foil film installed inside."

Next one example process executed by the controller 300 will be explained with reference to the flowchart shown in FIG. 20. In the flowchart of FIG. 20 and in the following description, activating and stopping operations of the upstream conveyor roller 11C, pressure roller 51, pick-up reel 35, and sheet ejection mechanism 12 will be typified only by the upstream conveyor roller 11C referred to simply as conveyor roller.

Upon receipt of a command to start transfer, the controller 300 starts executing the process of FIG. 20, and determines whether there is a sheet on the sheet tray 3 (S101). If an ON signal is received from the sheet tray sensor SS3, the controller 300 determines that a sheet S is placed on the sheet tray 3.

If it is determined in step S101 that there is no sheet on the sheet tray 3 (S101, No), the controller 300 waits until a sheet is placed on the sheet tray 3.

If it is determined in step S101 that a sheet S is on the sheet tray 3 (S101, Yes), the controller 300 determines whether the foil film F has a widthwise dimension of the second width W2 (S102).

If it is determined in step S102 that the widthwise dimension of the foil film F is the second width W2, i.e., the first film unit HA is installed (S102, Yes), the controller 300 executes the foil transfer process of steps S111 to S114.

When the foil transfer process is executed, the controller 300 causes the conveyor roller 11C to operate (S111). Then, the controller 300 causes the supply roller 11A to operate for a predetermined time period to pick up a sheet S placed on the sheet tray 3 (S112). The sheet S picked up by the supply roller 11A is conveyed by the transfer roller 11C to the transfer unit 50, and a foil is transferred thereon.

After step S112, the controller 300 determines whether a sheet S is on the sheet tray 3 (S113); if it is determined that a sheet is on the sheet tray 3 (S113, Yes), the controller 300 proceeds to step S112 to continue foil transfer. If it is determined that no sheet is on the sheet tray 3 (S113, No), the controller 300 stops the conveyor roller 11C (S114) and ends the process.

If it is determined in step S102 that the widthwise dimension of the foil film F is not the second width W2, but is the first width W1 (S102, No), the controller 300 determines whether the foil film F is shifted to one side (S103).

If it is determined in step S103 that the foil film F is not shifted to one side (S103, No), the foil film F is located in the center, i.e., the second film unit FU2 is installed, thus the controller 300 executes the foil transfer process of steps S111 to S114.

If it is determined in step S103 that the foil film F is shifted to one side, i.e., the third film unit FU3 is installed (S103, Yes), the controller 300 causes the conveyor roller 11C to operate (S20).

After step S20, the controller 300 causes the supply roller 11A to operate for a predetermined time period to pick up a sheet S placed on the sheet tray 3 (S22). The sheet S picked up by the supply roller 11A is conveyed by the conveyor roller 11C toward the transfer unit 50.

After step S22, the controller 300 determines, upon detection of a sheet S by the first sheet sensor SS1, whether the sheet-width sensor SS4 is detecting the sheet S (S23).

If it is determined in step S23 that the sheet-width sensor SS4 is detecting the sheet S upon detection of the sheet S by the first sheet sensor SS1 (S23, Yes), the controller 300 proceeds to step S113 and executes the foil transfer process.

On the other hand, if it is determined in step S23 that sheet-width sensor SS4 is not detecting any sheet S upon detection of a sheet S by the first sheet sensor SS1 (S23, No), the controller 300 stops operation of the conveyor roller 11C and shows an error representation on the display 24 (S24).

After step S24, the controller 300 determines whether the first sheet sensor SS1 is detecting the sheet S (S25).

If it is determined in step S25 that the first sheet sensor SS1 is detecting a sheet (S25, Yes), the sheet is still in the conveyance path, thus the controller 300 waits until the first sheet sensor SS1 fails to detect the sheet S.

If it is determined in step S25 that the first sheet sensor SS1 is not detecting the sheet S any more (S25, No), the sheet is not in the conveyance path, thus the controller 300 cancels the error representation (S26) and ends the process.

According to the second example described above, the following advantageous effects can be achieved.

If a sheet is not laid on the foil film F, or if an overlapping area of the foil film F and a sheet is inadequate when a sheet is conveyed, a leading edge of the sheet S may be wound around the heating member 61 or enter a gap between the first guide shaft 41 and the heating member 61 or between the heating member 61 and the second guide shaft 42, and the sheet S may move out of the conveyance path.

However, according to the foil transfer device 1, even if a foil film F of the first width W1 smaller than the second width W2 is installed in the off-center region R3, since the error process is executed on the condition that the sheet-width sensor SS4 located in the off-center region is not detecting any sheet S, a sheet may be restrained from being conveyed when the sheet is not laid on the foil film F, or when an overlapping area of the foil film F and a sheet is inadequate. As a result, the sheet S can be restrained from moving out of the conveyance path.

If the sheet-width sensor SS4 is not detecting a sheet S being conveyed and the foil-film sensor (first sensor AS1, second sensor AS2, and third sensor AS3) is detecting that the foil film F of a first width W1 is installed, the controller 300 executes the error process. On the other hand, even if the sheet-width sensor SS4 is not detecting a sheet S being conveyed, if the foil-film sensor is detecting that the foil film F of the first width W1 is not installed, i.e., if the foil-film sensor is detecting that the foil film F of the second width W2 is installed, the controller 300 does not execute the error process and executes the foil transfer process.

If the foil film of the second width W2 is installed, the foil film covers most of the conveyance path of a sheet S in the widthwise direction. Thus, the possibility of the leading edge of the sheet S being wound around the heating member 61, or entering a gap between the first guide shaft 41 and the heating member 61 or between the heating member 61 and the second guide shaft 42 will be reduced. However, when the foil film of the first width W1 is installed, there is an area in the widthwise direction of the foil film F in which no foil film is positioned in the conveyance path of a sheet S, and thus the possibility of the leading edge of the sheet S being wound around the heating member 61, or entering a gap between the first guide shaft 41 and the heating member 61 or between the heating member 61 and the second guide shaft 42 will rise. Therefore, the controller 300 can execute the error process in an appropriate situation.

If the sheet-width sensor SS4 is not detecting any sheet S being conveyed and the foil-film sensor (first sensor AS1, second sensor AS2, and third sensor AS3) is detecting that the foil film F of the first width is installed in the off-center region R3, the controller 300 executes the error process. On the other hand, even if the sheet-width sensor SS4 is not detecting any sheet S being conveyed, and the foil-film sensor is detecting that the foil film F of a first width W1 is installed, if the foil-film sensor is detecting that the foil film F of the first width W1 is not installed in the off-center region, i.e., if the foil-film sensor is detecting that the foil film F of the first width W1 is installed in the center region R2, the controller 300 does not execute the error process and executes the foil transfer process.

When the foil film is installed in the center, there is a high possibility that a center of the sheet S in the widthwise direction is positioned on the foil film F. Thus the possibility of the leading edge of the sheet S being wound around the heating member 61, or entering a gap between the first guide shaft 41 and the heating member 61 or between the heating member 61 and the second guide shaft 42 is low. However, when the foil film is installed in a position shifted to one side, there is a possibility that the center of the sheet S in the widthwise direction is not positioned on the foil film F, or positioned on an end portion of the foil film F, thus the possibility of the leading edge of the sheet S being wound around the heating member 61, or entering a gap between the first guide shaft 41 and the heating member 61 or between the heating member 61 and the second guide shaft 42 will rise. Therefore, the controller 300 can execute the error process in an appropriate situation.

Since the controller 300 stops the operation of the upstream conveyor roller 11C in the error process, the sheet S can be restrained from moving down out of the conveyance path or being wound around the heating member 61 so that the sheet S can be restrained from moving out of the conveyance path.

Next, a detailed description will be given of a third example of a foil transfer device. In this example, the position of the sheet-width sensor is different from that of the second example. In the following description, members having structures approximately the same as those of the members in the second example are identified by the same reference characters and explanation thereof is omitted.

As shown in FIG. 21, a sheet-width sensor SS5 of the third example is located upstream of the supply roller 11A in the conveyance direction. More specifically, the sheet-width sensor SS5 is provided at the sheet tray 3. The sheet-width sensor SS5 is located in the off-center region R3. The sheet-width sensor SS5 is located in a position shifted to one side from the center C of a sheet S in the widthwise direction. An ON signal is transmitted to the controller 300 while the sheet-width sensor SS5 is detecting a sheet S.

In this example, a position of the sheet-width sensor SS5 with reference to the center C of a sheet S in the widthwise direction is the same as that of the sheet-width sensor SS4 of the second example.

The sheet-width sensor SS5 may be located elsewhere as long as it is positioned upstream of the supply roller 11A in the conveyance direction; it may be positioned at the housing main body 21.

In the third example, the controller 300 is configured, upon receipt of a command to transfer foil, not to cause the upstream conveyor roller 11C to operate and to show an error representation on the display, as an error process, on the conditions that the foil-film sensor is detecting the foil film F of the first width W1 is installed in the off-center region R3, and that the sheet-width sensor SS5 is not detecting any sheet S. The error representation may, for example, read "The sheet used does not match the purpose of the foil film installed inside."

Next, one example of a process which is executed by the controller 300 of the third example will be described with reference to a flowchart of FIG. 22.

Steps S101 to S103 and steps S111 to S114 are the same as those of the second example; thus descriptions thereof will be omitted.

As shown in FIG. 22, if it is determined in step S103 that the foil film is shifted to one side (S103, Yes), the controller 300 determines whether the sheet-width sensor SS5 is detecting a sheet S (S31).

If it is determined in step S31 that the sheet-width sensor SS5 is detecting a sheet S (S31, Yes), the controller 300 causes the supply roller 11A to operate for a predetermined time period (S111) and executes the foil transfer process (S112).

On the other hand, in step S31, if it is determined that the sheet-width sensor SS5 is not detecting a sheet S (S31, No), the controller 300 displays an error (S32) and ends the process.

According to the third example described above, if it is determined that the sheet-width sensor SS5 located upstream of the supply roller 11A in the conveyance direction is not detecting a sheet S, the controller 300 does not cause the supply roller 11A to start operating. Since it is possible to determine whether or not the sheet-width sensor SS5 is detecting a sheet S before causing the supply roller 11A to start operating, the sheet may certainly be restrained from being conveyed when the sheet is not laid on the foil film F, or when an overlapping area of the foil film F and a sheet S is inadequate. As a result, the sheet S can be restrained from moving out of the conveyance path.

Since the controller 300 shows an error on the display 24 if it determines that the sheet-width sensor SS5 positioned upstream of the supply roller 11A in the conveyance direction is not detecting a sheet S, it will be easier for the user to become aware of the situation in which a sheet is not laid on the foil film F, or an overlapping area of the foil film F and a sheet S is inadequate, thus such situation can be more easily resolved by the user. As a result, the sheet S can be restrained from moving out of the conveyance path.

While the invention has been described in conjunction with various example structures outlined above and illustrated in the figures, various alternatives, modifications, variations, improvements, and/or substantial equivalents, whether known or that may be presently unforeseen, may become apparent to those having at least ordinary skill in the art. Accordingly, the example embodiments of the disclosure, as set forth above, are intended to be illustrative of the invention, and not limiting the invention. Various changes may be made without departing from the spirit and scope of the disclosure. Therefore, the disclosure is intended to embrace all known or later developed alternatives, modifications, variations, improvements, and/or substantial equivalents. Some specific examples of potential alternatives, modifications, or variations in the described invention are provided below.

Although the controller 300 executes the error process, upon receipt of a command to transfer foil, on conditions that the foil-film sensor is detecting a foil film F of a first width W1 is installed in the off-center region R3, and that the sheet-width sensor SS4 is not detecting any sheet S in the above-described example, the present disclosure is not limited to this configuration.

For example, the controller 300 may be configured to execute the error process, upon receipt of a command to transfer foil, on conditions that the foil-film sensor is detecting a foil film F of the first width W1 is installed, and that the sheet-width sensor SS4 is not detecting any sheet S.

Further, the controller 300 may be configured to execute the error process upon receipt of a command to transfer foil on the condition that the sheet-width sensor SS4 is not detecting any sheet S.

Although the sheet tray sensor SS3 is provided at the sheet tray 3, this is not a requirement. For example, the sheet tray sensor SS3 may be provided between the sheet tray 3 and the supply roller 11A. That is, the sheet tray sensor SS3 may be located at the housing main body 21 as long as it is located upstream of the supply roller 11A in the conveyance direction.

Although the sheet-width sensor SS4 is located at a position a little upstream than that of the first sheet sensor SS1 in the conveyance direction in the above-described example, the sheet-width sensor SS4 may be configured to be located at the same position as that of the first sheet sensor SS1.

Although the foil transfer device is configured to transfer foil made of aluminum, etc. on a toner image printed in advance in the above-described example, the present disclosure may be applied to a so-called thermal head type foil transfer device which uses an ink ribbon for thermal transfer. In this case, a transfer unit for transferring foil is comprised of a thermal head and a platen roller.

Although a width of a sheet S is detected by a sheet-width sensor SS4 in the above-described example, the width of the sheet S may be set by a user.

Although the pressure roller 51 is driven by the motor and the heating member 61 is caused to rotate thereby in the above-disclosed example, the heating member 61 may be driven by a motor and the pressure roller 51 may be caused to rotate thereby.

Although the foil transfer device 1 is capable of installing three types of foil films F, i.e., the first film cartridge FC5, the second film cartridge FC6, and the third film cartridge FC7 in the above-described example, other foil films F with sizes other than illustrated above may be installed.

Although the foil film F is comprised of four layers in the above-described example, the foil film may include any number of layers as long as it includes a transfer layer and a support layer.

Although the foil transfer device 1 is configured as a device separate from an image forming apparatus such as a laser printer in the above-described example, the foil transfer device may be configured integral with an image forming device.

In the above-described example, the position of the foil film of the first width is changed between the off-center region and the center region by replacing a cartridge. However, the position of the foil film of the first width may be changed between the off-center region and the center region such as by operating a lever as in the cartridge of the first example. In this case, instead of using the foil-film sensor, it is possible to detect whether the foil film is installed in the off-center region or the center region by detecting the position of the lever by a sensor SE such as disclosed in the first example.

The elements described in the above embodiments and modifications may be implemented selectively and in combination.

What is claimed is:

1. A foil transfer film cartridge comprising:

a supply reel on which a foil film having a widthwise dimension of a first width is wound;

a supply shaft longer in a widthwise direction of the foil film than the first width, the supply shaft being configured to extend through a hole formed in the supply reel to support the supply reel in a manner that allows the supply reel to move in the widthwise direction between a first position and a second position different from the first position;

a lever moveable together with the supply reel in the widthwise direction; and a supply case configured to contain the supply reel, the supply case having an opening though which the lever is exposed.

2. The foil transfer film cartridge according to claim 1, wherein when the supply reel is located in the first position, the foil film is located apart from one end of the supply shaft by a first distance, and when the supply reel is located in the second position, the foil film is located apart from the one end of the supply shaft by a second distance greater than the first distance, and wherein when the supply reel is located in the first position, the lever is located within the first distance from the one end of the supply shaft.

3. The foil transfer film cartridge according to claim 2, comprising a flange located at one end of the supply reel, the flange being configured to rotate together with the supply reel, wherein the lever is engaged with the flange in the widthwise direction.

4. The foil transfer film cartridge according to claim 3, comprising a supply-position locating part configured to locate the supply reel in the first position or the second position.

5. The foil transfer film cartridge according to claim 4, wherein the supply-position locating part comprises:

a first projection; and a hole that allows the first projection to be fitted therein.

6. The foil transfer film cartridge according to claim 5, wherein the supply-position locating part comprises:

the first projection formed on the lever;

a first hole formed in the supply case in a manner that allows the first projection to be fitted therein, the first hole being located in a position corresponding to the first position; and a second hole formed in the supply case in a manner that allows the first projection to be fitted therein, the second hole being located in a position corresponding to the second position.

7. The foil transfer film cartridge according to claim 3, wherein the supply shaft is rotatable together with the supply reel and the flange, and wherein the lever is not engaged with the flange in a direction of rotation of the flange.

8. The foil transfer film cartridge according to claim 1, comprising:

a take-up reel on which to take up the foil film; and a take-up shaft longer in the widthwise direction than the first width, the take-up shaft being configured to support the take-up reel in a manner that allows the take-up reel to move in the widthwise direction between a third position and a fourth position different from the third position.

9. The foil transfer film cartridge according to claim 8, comprising a take-up-position locating part configured to locate the take-up reel in the third position or the fourth position.

10. The foil transfer film cartridge according to claim 9, wherein the take-up-position locating part comprises:

a second projection; and a hole that allows the second projection to be fitted therein.

11. The foil transfer film cartridge according to claim 10, wherein the take-up-position locating part comprises:

the second projection movable together with the take-up reel in the widthwise direction;

a third hole formed in the take-up shaft in a manner that allows the second projection to be fitted therein, the third hole being located in a position corresponding to the third position; and a fourth hole formed in the take-up shaft in a manner that allows the second projection to be fitted therein, the fourth hole being located in a position corresponding to the fourth position.

12. The foil transfer film cartridge according to claim 11, wherein when the take-up reel is located in the third position, the foil film is located apart from one end of the take-up shaft by a third distance, and when the take-up reel is located in the fourth position, the foil film is located apart from the one end of the take-up shaft by a fourth distance greater than the third distance, and wherein when the take-up reel is located in the third position, the second protrusion is located within the third distance from the one end of the take-up shaft.

13. A foil transfer device comprising:

the foil transfer film cartridge according to claim 1;

a housing main body configured to allow the foil transfer film cartridge to be removably installed therein;

a sensor capable of detecting the lever; and a controller configured to determine a position of the supply reel in the widthwise direction based on information from the sensor.

14. The foil transfer device according to claim 13, comprising:

a heating member configured to heat the foil film;

a first heater configured to heat a first portion of the heating member at an intensity higher than an intensity at which the first heater is configured to heat a second portion of the heating member, the second portion being arranged side by side with the first portion in the widthwise direction; and a second heater configured to heat the second portion at an intensity higher than an intensity at which the second heater is configured to heat the first portion, wherein the foil film only overlaps the first portion when the supply reel is positioned in the first position, and the foil film overlaps the first portion and the second portion when the supply reel is positioned in the second position, and wherein the controller is configured such that:

during a foil transfer process, the first heater is controlled at a predetermined power consumption and the second heater is controlled at a first power consumption or a second power consumption smaller than the first power consumption;

if it is determined that the supply reel is positioned in the first position, the second heater is controlled at the second power consumption; and if it is determined that the supply reel is positioned in the second position, the second heater is controlled at the first power consumption.

15. The foil transfer device according to claim 13, wherein the sensor comprises:

a first actuator configured to contact the lever and move when the foil transfer film cartridge with the supply reel positioned in the first position is being installed into the housing main body;

a first sensor configured to detect a position of the first actuator;

a second actuator configured to contact the lever and move when the foil transfer film cartridge with the supply reel positioned in the second position is being installed into the housing main body; and a second sensor configured to detect a position of the second actuator.

16. The foil transfer device according to claim 15, wherein the housing main body is configured to allow a second foil transfer film cartridge to be removably installed therein, the second foil transfer film cartridge comprising a foil film having a widthwise dimension of a second width greater than the first width, and wherein when the second foil transfer film cartridge is being installed into the housing main body, the first actuator and the second actuator contact the second foil transfer film cartridge and move.

17. A foil transfer device for laying a sheet on a foil film and transferring foil onto the sheet, in which the foil transfer film cartridge according to claim 1 with the foil film having the widthwise dimension of the first width being wound therein, and a foil film having a widthwise dimension of a second width greater than the first width are selectively installable, wherein the foil film having the widthwise dimension of the first width is installable in a off-center region of an area in which the foil film having the widthwise dimension of the second width is installable, the off-center region being shifted widthwise to one side of the area, the foil transfer device comprising:

a conveyor roller configured to convey a sheet;

a transfer unit configured to nip and heat the foil film and the sheet conveyed by the conveyor roller;

a sheet-width sensor capable of detecting a sheet passing through the off-center region; and a controller, wherein the controller is configured to execute, when receiving a command to transfer foil, an error process if the sheet-width sensor is not detecting a sheet.

18. The foil transfer device according to claim 17, further comprising a foil-film sensor configured to detect a width of the foil film installed in the foil transfer device, wherein the controller is configured to execute, when receiving the command to transfer foil, the error process on conditions that the foil-film sensor is detecting a foil film having a widthwise dimension of the first width is installed, and that the sheet-width sensor is not detecting a sheet.

19. The foil transfer device according to claim 18, wherein the foil film having the widthwise dimension of the first width is installable in a center region of an area in which the foil film having the widthwise dimension of the second width is installable, the center region being a region shifted widthwise to a center of the area, wherein the foil-film sensor is further capable of detecting whether the foil film having the widthwise dimension of the first width is installed in the off-center region or the center region, and wherein the controller is configured to execute, when receiving the command to transfer foil, the error process on conditions that the foil-film sensor is detecting the foil film having the widthwise dimension of the first width is installed in the off-center region, and that the sheet-width sensor is not detecting a sheet.

20. The foil transfer device according to claim 17, further comprising a sheet tray configured to hold a sheet, and a supply roller that picks up the sheet placed on the sheet tray, wherein the conveyor roller is capable of conveying the sheet picked up by the supply roller to the transfer unit, and wherein the sheet-width sensor is located in a position between the supply roller and the transfer unit in the direction of conveyance of the sheet.

21. The foil transfer device according to claim 20, wherein the controller is configured to stop operation of the conveyor roller in the error process.

22. The foil transfer device according to claim 17, further comprising a sheet tray configured to hold a sheet, and a supply roller that picks up the sheet placed on the sheet tray, wherein the conveyor roller is capable of conveying the sheet picked up by the supply roller to the transfer unit, and wherein the sheet-width sensor is located upstream of the supply roller in the direction of conveyance of the sheet.

23. The foil transfer device according to claim 22, wherein the controller is configured not to cause the supply roller to operate in the error process.

24. The foil transfer device according to claim 17, wherein the controller is configured to provide notification of error information in the error process.

25. The foil transfer device according to claim 17, wherein the transfer unit comprises a heating member to be heated by a heater, and a pressure roller configured to nip and convey, in combination with the heating member, the foil film and a sheet held between the pressure roller and the heating member.

26. A transfer film cartridge comprising:

a supply reel on which a film comprised of a plurality of layers and having a widthwise dimension of a first width is wound;

a supply shaft longer in a widthwise direction of the film than the first width, the supply shaft being configured to extend through a hole formed in the supply reel to support the supply reel in a manner that allows the supply reel to move in the widthwise direction between a first position and a second position different from the first position;

a lever moveable together with the supply reel in the widthwise direction; and a supply case configured to contain the supply reel, the supply case having an opening through which the lever is exposed.

27. The transfer film cartridge according to claim 26, wherein when the supply reel is located in the first position, the film is located apart from one end of the supply shaft by a first distance, and when the supply reel is located in the second position, the film is located apart from the one end of the supply shaft by a second distance greater than the first distance, and wherein when the supply reel is located in the first position, the lever is located within the first distance from the one end of the supply shaft.

28. The transfer film cartridge according to claim 27, comprising a flange located at one end of the supply reel, the flange being configured to rotate together with the supply reel, wherein the lever is engaged with the flange in the widthwise direction.

29. The transfer film cartridge according to claim 28, comprising a supply-position locating part configured to locate the supply reel in the first position or the second position.

30. The transfer film cartridge according to claim 29, wherein the supply-position locating part comprises:

a first projection; and a hole that allows the first projection to be fitted therein.

31. A transfer film cartridge comprising:

a supply reel on which a film comprised of a plurality of layers and having a widthwise dimension of a first width is wound;

a supply shaft longer in a widthwise direction of the film than the first width, the supply shaft being configured to extend through a hole formed in the supply reel to support the supply reel in a manner that allows the supply reel to move in the widthwise direction between a first position and a second position different from the first position;

a take-up reel on which to take up the film; and a take-up shaft longer in the widthwise direction than the first width, the take-up shaft being configured to support the take-up reel in a manner that allows the take-up reel to move in the widthwise direction between a third position and a fourth position different from the third position.

* * * * *